US005771026A

United States Patent [19]

Stengel, Jr.

[11] Patent Number: 5,771,026

[45] Date of Patent: Jun. 23, 1998

[54] DISGUISED BROADBAND ANTENNA SYSTEM FOR VEHICLES

[75] Inventor: Francis A. Stengel, Jr., Lancaster, N.Y.

[73] Assignee: Sti-Co Industries, Inc., Orchard Park, N.Y.

[21] Appl. No.: 626,623

[22] Filed: Mar. 28, 1996

[51] Int. Cl.[6] ..... H01Q 1/50

[52] U.S. Cl. ..... 343/858; 343/715; 343/745; 343/850; 343/852; 343/860

[58] Field of Search ..... 343/745, 850, 343/851, 852, 711, 713, 715, 858, 860, 865

[56] References Cited

U.S. PATENT DOCUMENTS

| | | | |
|---|---|---|---|
| 2,920,323 | 1/1960 | Dunson | 343/850 |
| 3,725,942 | 4/1973 | Ukmar | 343/745 |
| 4,085,405 | 4/1978 | Barlow | 343/850 |
| 4,141,016 | 2/1979 | Nelson | 343/858 |
| 5,258,728 | 11/1993 | Taniyoshi et al. | 343/860 |

*Primary Examiner*—Donald T. Hajec
*Assistant Examiner*—Tho Phan
*Attorney, Agent, or Firm*—Hodgson, Russ, Andrews, Woods & Goodyear LLP

[57] ABSTRACT

A disguised broadband antenna system for use with a broadcast radio receiver and communications apparatus in a vehicle wherein the antenna system comprises a standard broadcast antenna mounted to the vehicle by means of a base, a distributed matching network for coupling the antenna to the broadcast receiver and the communications equipment in the vehicle and a broadcast coupler connected between the matching network and the broadcast receiver and communications equipment for providing isolation between the broadcast receiver and communications equipment. The distributed nature of the matching network provides the broadband frequency response required while at the same time providing the highest Q factor available in a limited size and spreads any power dissipation over a relatively larger area. A series reactive element is connected electrically to the antenna through the base to cause the antenna to operate closer to resonance through the broadband frequency range of interest. The distributed matching network comprises at least one transmission line connected to the series reactive element and matching elements operatively associated with the transmission line to provide characteristics of the matching network resulting in broad bandwidth, low standing wave ratio and low power loss operation of the broadcast receiver and the communications equipment from the antenna so that the antenna and base maintain the outer visible appearance of a standard vehicle antenna.

11 Claims, 30 Drawing Sheets

DISGUISED BROADBAND ANTENNA SYSTEM FOR VEHICLES

BACKGROUND OF THE INVENTION

This invention relates to the art of antenna systems for broadcast radios and communications equipment located in vehicles, and more particularly to a new and improved vehicle disguised antenna system with matching network providing broadband operation.

An important area of use of the present invention is disguised antenna systems for vehicles containing both standard broadcast radios and communications equipment such as transceivers for surveillance, law enforcement and similar functions. By disguised it is meant that the antenna and its mounting to the vehicle maintain the outward visible appearance of a standard radio broadcast antenna so as not to reveal the presence of surveillance communications equipment and the like in the vehicle.

A basic disguised antenna system includes a standard broadcast antenna mounted to a vehicle by means of a base, a matching network for matching the impedance of the broadcast radio and communication equipment such as a transceiver in the vehicle to the antenna on the outside of the vehicle and a broadcast coupler for providing isolation between the broadcast radio and the communications equipment. Such disguised antenna systems for vehicles have been provided for narrow band operation of the communications equipment. Matching networks for such narrow band systems typically include lumped parameter elements such as capacitors and inductors connected in various series and parallel combinations.

While it would be highly desirable to provide a broadband disguised antenna system for vehicles, a number of exceedingly difficult problems have been encountered. Both the size and number of components required for broadband operation in a lumped parameter matching network make it impossible to connect the network directly adjacent the base of the antenna due to space constraints within the vehicle. However, any attempt to move the lumped parameter components of the matching network away from the base of the antenna causes an immediate and significant reduction in bandwidth. Also, the power levels encountered during operation of communications equipment such as transceivers can be high enough to damage individual lumped parameter components or at least their soldered connections to the remainder of the network. Another problem encountered is that while on the one hand in order to provide the broad bandwidth required the antenna must be resonant, on the other hand a standard vehicle broadcast antenna which typically is 28 to 36 inches in length is not resonant in the VHF band.

SUMMARY OF THE INVENTION

It is, therefore, a primary object of this invention to provide a new and improved vehicle disguised antenna system providing broadband operation.

It is further object of this invention to provide such an antenna system wherein the antenna is a standard broadcast antenna which is mounted on the vehicle with no outwardly visible modifications to the vehicle, antenna or mounting hardware.

It is a further object of this invention to provide such an antenna system which can handle the full power requirements of communications equipment such as a transceiver over the broad frequency range of interest.

It is a further object of this invention to provide such an antenna system enabling broadcast radio operation with minimal signal reduction and no damage to the broadcast radio during operation of the communications equipment such as during transmitting without any switches or relays.

It is a more particular object of this invention to provide such an antenna system wherein the matching network provides a relatively low standing wave ratio over a relatively wide frequency range including the entire frequency bands of interest without any form of returning during the operational life of the antenna system.

It is a more particular object of this invention to provide such an antenna system which is low loss in that the power of the transmitter or other communications equipment is not significantly attenuated by the matching network.

The present invention provides a broadband antenna system for use with a broadcast radio receiver and communications apparatus in a vehicle wherein the antenna system comprises a standard broadcast antenna mounted to the vehicle by means of a base, a distributed matching network for coupling the antenna to the broadcast receiver and the communications equipment in the vehicle and a broadcast coupler connected between the matching network and the broadcast receiver and communications equipment for providing isolation between the broadcast receiver and communications equipment. The distributed nature of the matching network provides the broadband frequency response required while at the same time providing the highest Q factor available in a limited size and spreads any power dissipation over a relatively larger area. A series reactive element is connected electrically to the antenna through the base to cause the antenna to operate closer to resonance through the broadband frequency range of interest. The distributed matching network comprises transmission line means connected to the series reactive element and matching means operatively associated with the transmission line means to provide characteristics of the matching network resulting in broad bandwidth, low standing wave ratio and low power loss operation of the broadcast receiver and the communications equipment from the antenna so that the antenna and base maintain the outer visible appearance of a standard vehicle antenna.

The transmission line means comprises at least one transmission line having one end connected to the series reactive element and having an opposite end, and the matching means comprise a first matching element connected to the junction of the transmission line and series reactive element and a second matching element connected to the opposite end of the transmission line. Typically, a plurality of series-connected transmission line sections are provided, with matching elements connected to the junction of the first transmission line section and series reactive element, to each of the junctions of the transmission line sections and to the end of the last transmission line section. The matching elements comprise capacitors, inductors or transmission line sections connected in shunt relation to or in series with the transmission line means. Alternatively, the matching means can comprise alterations in the characteristic impedances and in the lengths of the transmission line sections, with or without lumped reactive elements connected to the transmission line sections, or the transmission line means can comprise a plurality of sections of microstrip transmission line sections in series and the matching means can comprise variations in the length and width of the microstrip sections.

The foregoing and additional advantages and characterizing features of the present invention will become clearly apparent upon a reading of the ensuing detailed description together with the included drawing.

BRIEF DESCRIPTION OF THE DRAWING FIGURES

Figure 13:
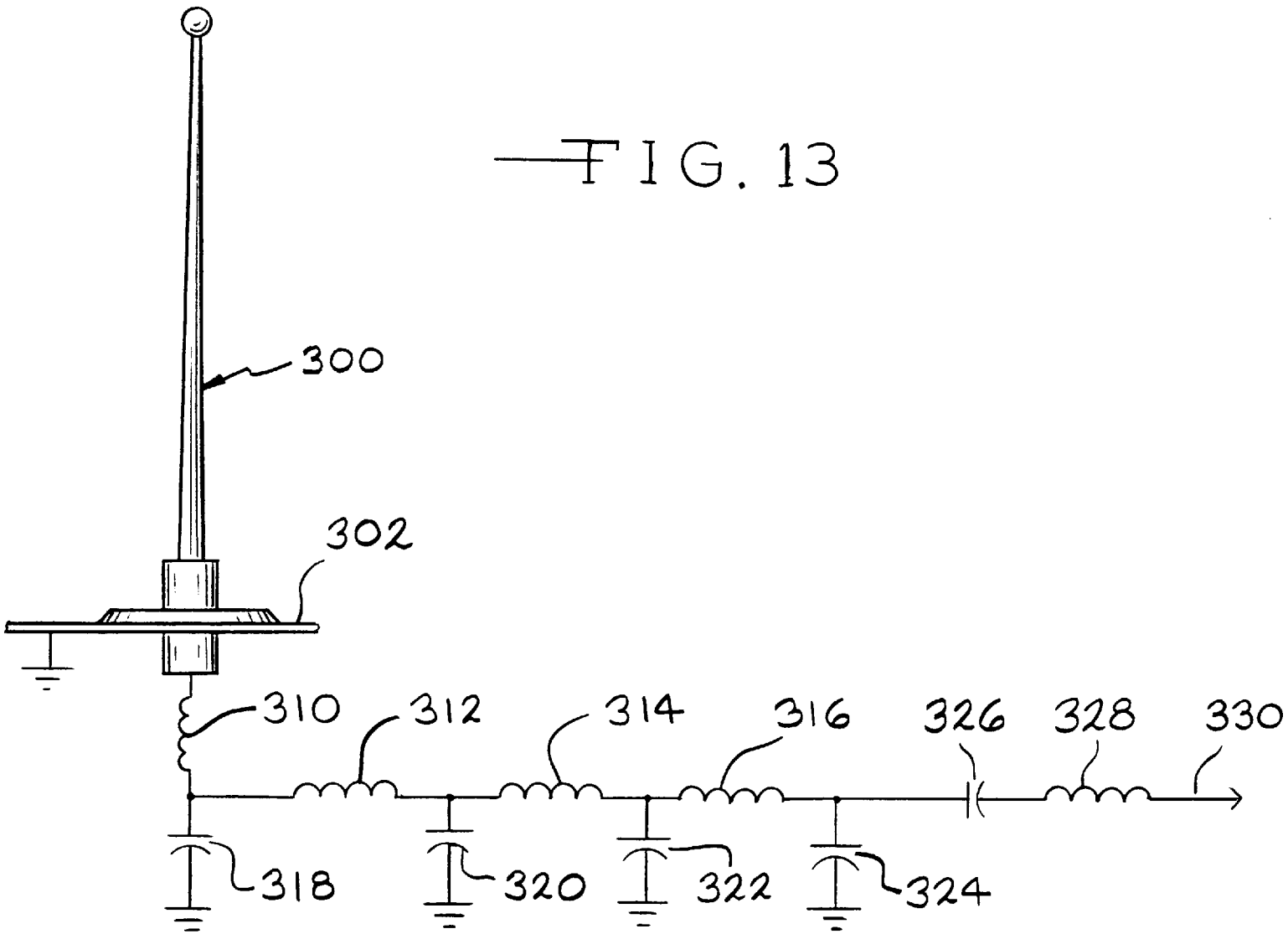
FIG. 13 is a schematic circuit diagram of an exemplary prior art lumped parameter matching network.

FIGS. 15, 17, 19 and 21 are schematic circuit diagrams of exemplary matching networks of the present invention for comparison to the network of FIG. 13; and FIGS. 16, 18, 20 and 22 are graphs including plots of voltage standing wave ratio vs. frequency for the networks of FIGS. 15, 17, 19 and 21, respectively.

DETAILED DESCRIPTION OF THE ILLUSTRATED EMBODIMENTS

When communications equipment such as a transceiver is installed in an automobile, truck or similar vehicle for surveillance, law enforcement and like functions it is important that nothing visible on the exterior of the vehicle reveal the presence of such communications equipment. Thus, the vehicle antenna must look like an ordinary vehicle broadcast antenna. Accordingly, disguised antenna systems are provided for vehicles containing both standard broadcast radios and communications equipment such as transceivers for surveillance, law enforcement and similar functions. By disguised it is meant that the antenna and its mounting to the vehicle maintain the outward visible appearance of a standard radio broadcast antenna so as not to reveal the presence of surveillance communications equipment and the like in the vehicle.

A basic disguised antenna system includes a standard broadcast antenna mounted to a vehicle by means of a base, a matching network for matching the impedance of the broadcast radio and communication equipment such as transceiver in the vehicle to the antenna on the outside of the vehicle and a broadcast coupler for providing isolation between the broadcast radio and the communications equipment. Such disguised antenna systems for vehicles have been provided for narrow band operation of the communications equipment. Matching networks for such narrow band systems typically include lumped parameter elements such as capacitors and inductors connected in various series and parallel combinations.

While it would be highly desirable to provide a broadband disguised antenna system for vehicles, such an accomplishment is by no means a mere adaptation of narrow band technology. In the first place a number of criteria must be satisfied. Of course, the antenna must be of a disguised nature, i.e. it must look like the original antenna mounted on a vehicle by the original manufacturer. In addition, the antenna must have a solid stainless steel mast between 28 to 36 inches in length. The antenna system must provide a low SWR (Standing Wave Ratio), and the antenna SWR must be low over a wide frequency range. As a matter of fact, the antenna system should cover the entire bands of interest. For example, Hi Band or VHF Band antennas should cover the entire frequency range of 150 MHz to 174 MHz without any form of returning during operational life of the antenna system. The same should be true for UHF band antennas in covering the entire frequency range of 403 MHz to 470 MHz. The antenna must be capable of withstanding the full power of standard production model commercial radio products. The antenna should also provide an output port for the OEM supplied entertainment radio (both AM 530 KHz to 1.6 MHz and FM 88 to 108 MHz) and should be usable with minimal signal reduction and no damage while transmitting without any switches or relays. In addition, the antenna system should be low loss. In other words, the transmitter power must not be significantly attenuated by the matching network used to provide the goals as stated above. Finally, the antenna should mount in the vehicle with no outwardly visible modifications to the vehicle.

In addition to the number of criteria which must be satisfied, a number of exceedingly difficult problems must be solved. Both the size and number of components required for broadband operation in a lumped parameter matching network make it impossible to connect the network directly adjacent the base of the antenna due to space constraints within the vehicle. In other words, the regions within the vehicle body under the front or rear fender areas where antennas typically are mounted are too small to accommodate the size and number of inductors and capacitors which would comprise the lumped parameter matching network. However, any attempt to move the lumped parameter components of the matching network away from the base of the antenna while still electrically connected to the antenna by the circuit leads causes an immediate and significant reduction in bandwidth. Also, the power levels encountered during broadband operation of communications equipment such as transceivers can be high enough to damage individual lumped parameter components or at least their soldered connections to the remainder of the network.

In accordance with the present invention, the foregoing criteria are satisfied and the foregoing problems are solved by an antenna system including a distributed matching network. The distributed nature of the matching network provides the broadband frequency response required while at the same time providing the highest Q factor available in the limited size dictated by the structure of the vehicle at the locations where antennas are mounted. In addition, the distributed nature of the matching network spreads any power dissipation and resulting heat over a relatively larger area, in contrast to being concentrated on discrete lumped parameter elements such as capacitors and inductors together with their soldered connections to the circuit board network.

Figure 1:
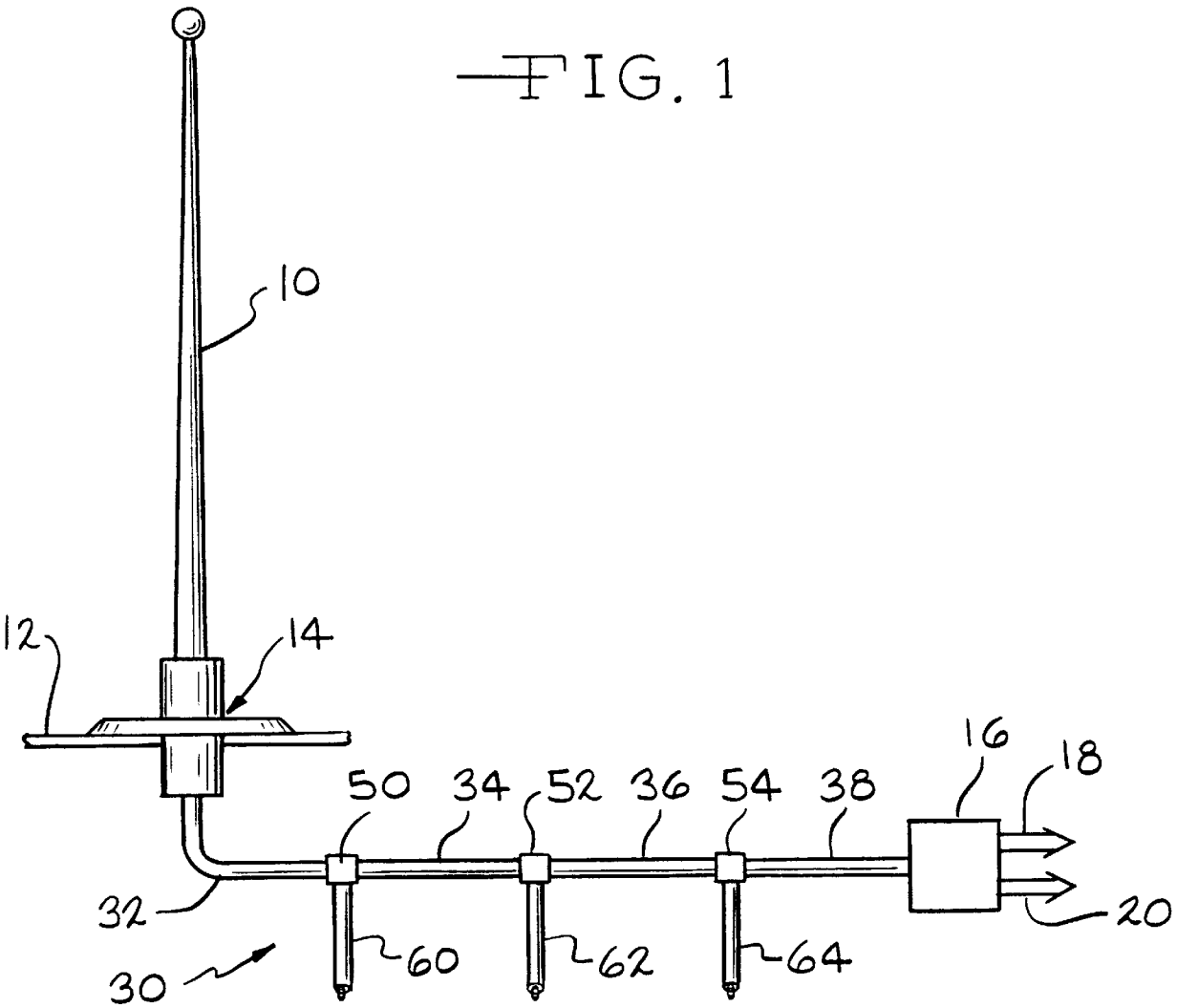
FIG. 1 is a schematic diagram of a broadband antenna system for vehicles including a distributed matching network according to the present invention.

Referring to FIG. 1, there is shown a broadband antenna system for vehicles including a distributed matching network according to the present invention. A standard vehicle mast or whip-type antenna 10 is mounted on an exterior surface 12 of the vehicle by means of base 14. The vehicle contains a standard broadcast or entertainment radio (not shown) and communications equipment such as a radio transmitter or transceiver (not shown). Isolation between the broadcast radio receiver and communications equipment is provided by a broadcast coupler 16 in a known manner which is connected between conductors 18 and 20 leading to the broadcast receiver and communications equipment, respectively. The impedance of the broadcast receiver and communications equipment is matched to the impedance of antenna 10 by the distributed matching network 30 of the present invention. Matching network 30 includes a series of transmission lines 32, 34, 36 and 38 each in the form of a coaxial cable. While four transmission line sections are shown by way of example, the actual number will depend upon the particular frequencies involved and other components of the matching network as will be described. The first transmission line 32 in the series is coupled to antenna 10 through base 14 in a manner which will be described, and the last transmission line 38 in the series is connected to broadcast coupler 16. The transmission lines 32, 34, 36 and 38 are connected in series by means of stub junctions 50, 52 and 54 in a known manner. Thus, the transmission lines 32, 34, 36 and 38 comprise series matching elements of the network 30. There is also provided a plurality of shunt matching elements in the form of coaxial cable transmission lines 60, 62 and 64 connected to the stub junctions 50, 52 and 54, respectively. By using a Smith Chart, the lengths of each of the series transmission lines 32, 34, 36 and 38 and of each of the shunt transmission lines are adjusted to obtain the best possible impedance match.

The broadband antenna system with matching network according to the present invention as shown in FIG. 1 satisfies all of the criteria specified hereinabove. Transmission lines are high Q devices and the matching network according to the present invention with at least one transmission line in the series path between antenna 10 and broadcast coupler 16 provides the Q for the transformation needed to achieve broadband operation. In addition, the series transmission line(s) solve the aforementioned problem of moving the matching network away from the antenna base to deal with the space constraints in vehicles. As is apparent from FIG. 1, one end of the series transmission line, i.e. the end of transmission line 32, is coupled to antenna 10 through base 14 and the remainder of network 30 need not be immediately adjacent antenna base 14. The high Q nature of the transmission lines avoids any sacrifice of the wide bandwidth desired. Also, the series transmission line(s) solve the aforementioned problem of handling the high power levels encountered during broadband operation of communications equipment such as transceivers. The transmission line distributes power and any heat associated with power dissipation over a relatively larger area in contrast to lumped parameter elements such as capacitors and inductors wherein the potentially damaging heat from power dissipation is concentrated on the individual devices and their soldered connections to the remainder of the circuit.

Figure 2:
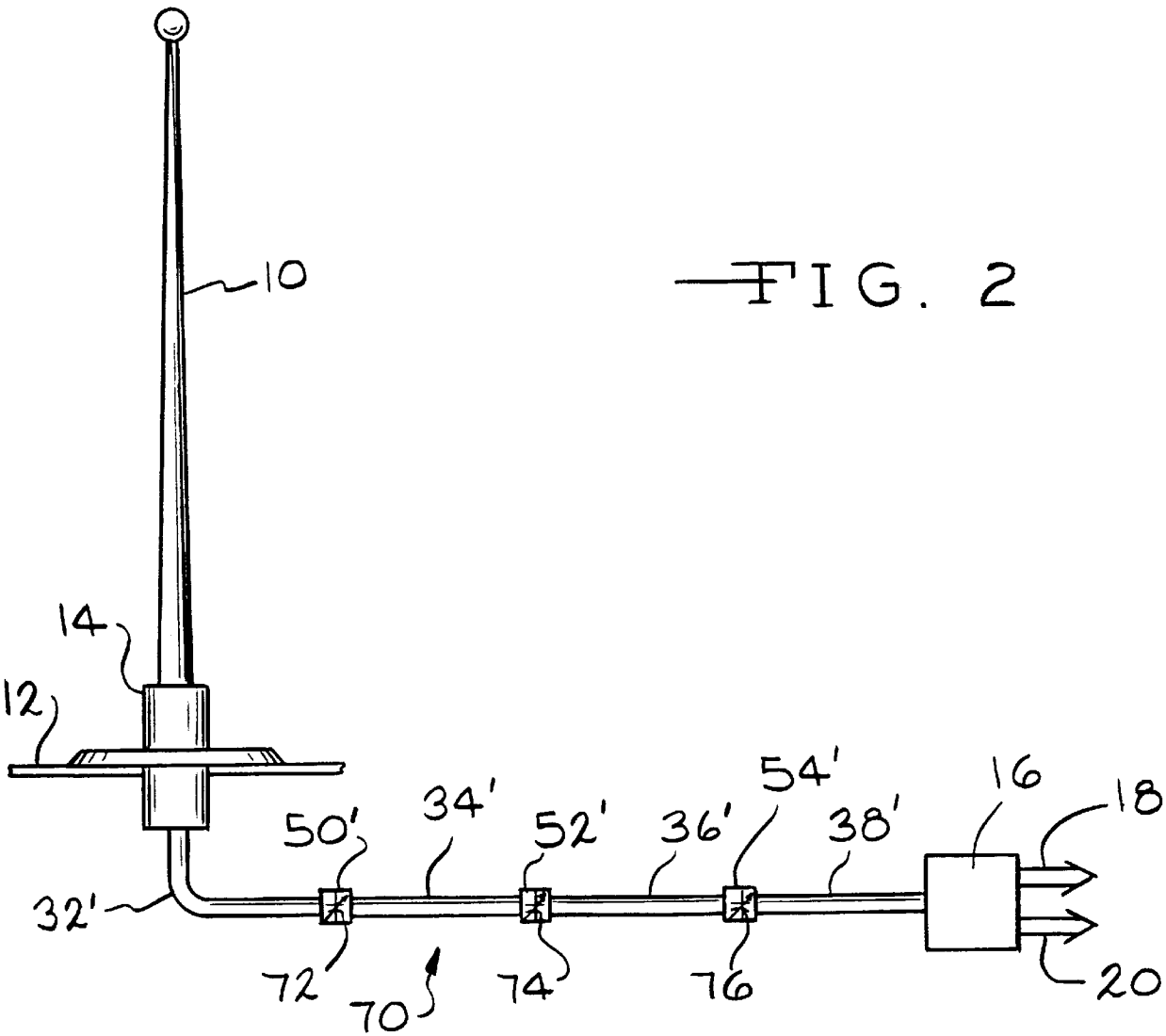
FIG. 2 is a schematic diagram of another form of broadband antenna system with matching network according to the present invention.

The antenna system with matching networks shown in FIG. 1 provides an excellent frequency response, but the shunt coaxial elements 60, 62 and 64 can be difficult to tune. FIG. 2 shows another form of broadband antenna system with matching network wherein the shunt coaxial matching elements are replaced by lumped reactive matching elements in the form of series or parallel capacitors or inductors. In the illustrative matching network 70 shown in FIG. 2, the series-connected transmission lines 32', 34', 36' and 38' are joined by stub junction 50', 52' and 54' in a manner similar to network 30 in FIG. 1. A plurality of shunt matching elements in the form of variable capacitors 72, 74 and 76 are connected to the stub junctions 50', 52' and 54', respectively. By using a Smith Chart, the lengths of the series transmission lines 32', 34', 36' and 38' and the magnitudes of capacitors 72, 74 and 76 are adjusted to obtain the best possible impedance match. The variable capacitors 72, 74, 76 have the advantage of ease in tuning. While lumped parameter elements do not have the better frequency response provided by transmission lines, they do have the capability of maintaining a wide bandwidth.

Figure 3:
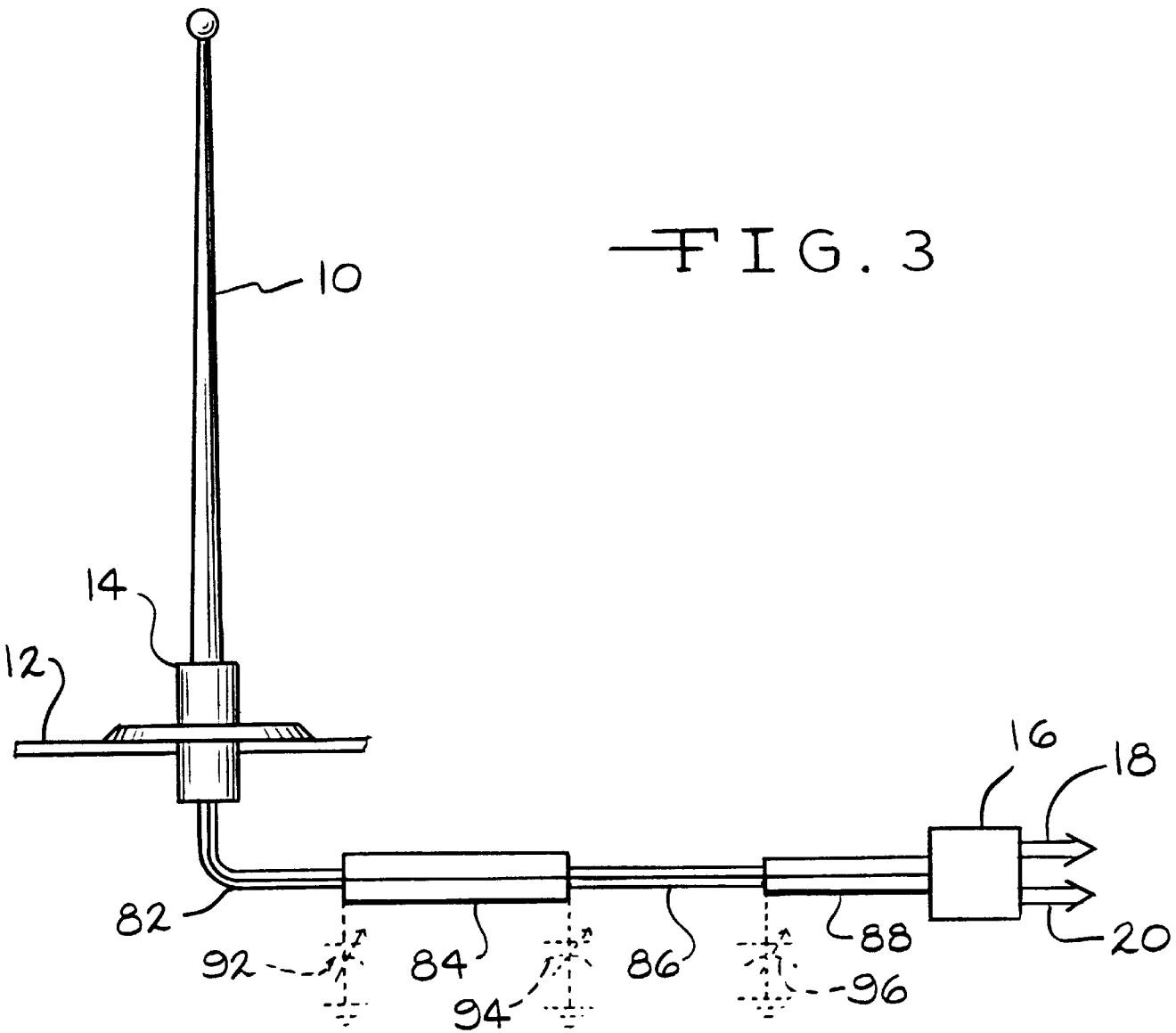
FIG. 3 is a schematic diagram of another form of broadband antenna system with matching network according to the present invention.

FIG. 3 illustrates an alternative form of broadband antenna system with matching network wherein impedance matching is provided by altering the characteristic impedance along with the length of the series-connected transmission lines to obtain the desired results of broad bandwidth and low power loss. The matching network 80 includes a first transmission line 82 coupled at one end through base 14 to antenna 10 and joined at the opposite end to a second transmission line 84 of larger outer diameter so as to have a different characteristic impedance. Transmission line 84 is joined to one end of the third transmission line 86 having substantially the same characteristic impedance as transmission line 82. The opposite end of transmission line 86 is joined to one end of a fourth transmission line 88 having a larger outer diameter than line 86 but smaller than that of line 84 so as to have a characteristic impedance different from that of the other lines. The opposite end of transmission line 88 is connected to broadcast coupler 16. By using a Smith Chart, the lengths of the transmission lines 82, 84, 86 and 88 are adjusted and the characteristic impedances of transmission lines 84 and 88 are changed to obtain the best impedance match. In a variation of the matching network 80 shown in FIG. 3, shunt reactive elements in the form of variable capacitors 92, 94 and 96 can be connected as shown in broken lines in FIG. 3 to the junctions of the transmission lines 82, 84, 86 and 88. The shunt reactive elements would be adjusted in magnitude along with the lengths and characteristic impedances of the transmission lines.

Figure 4:
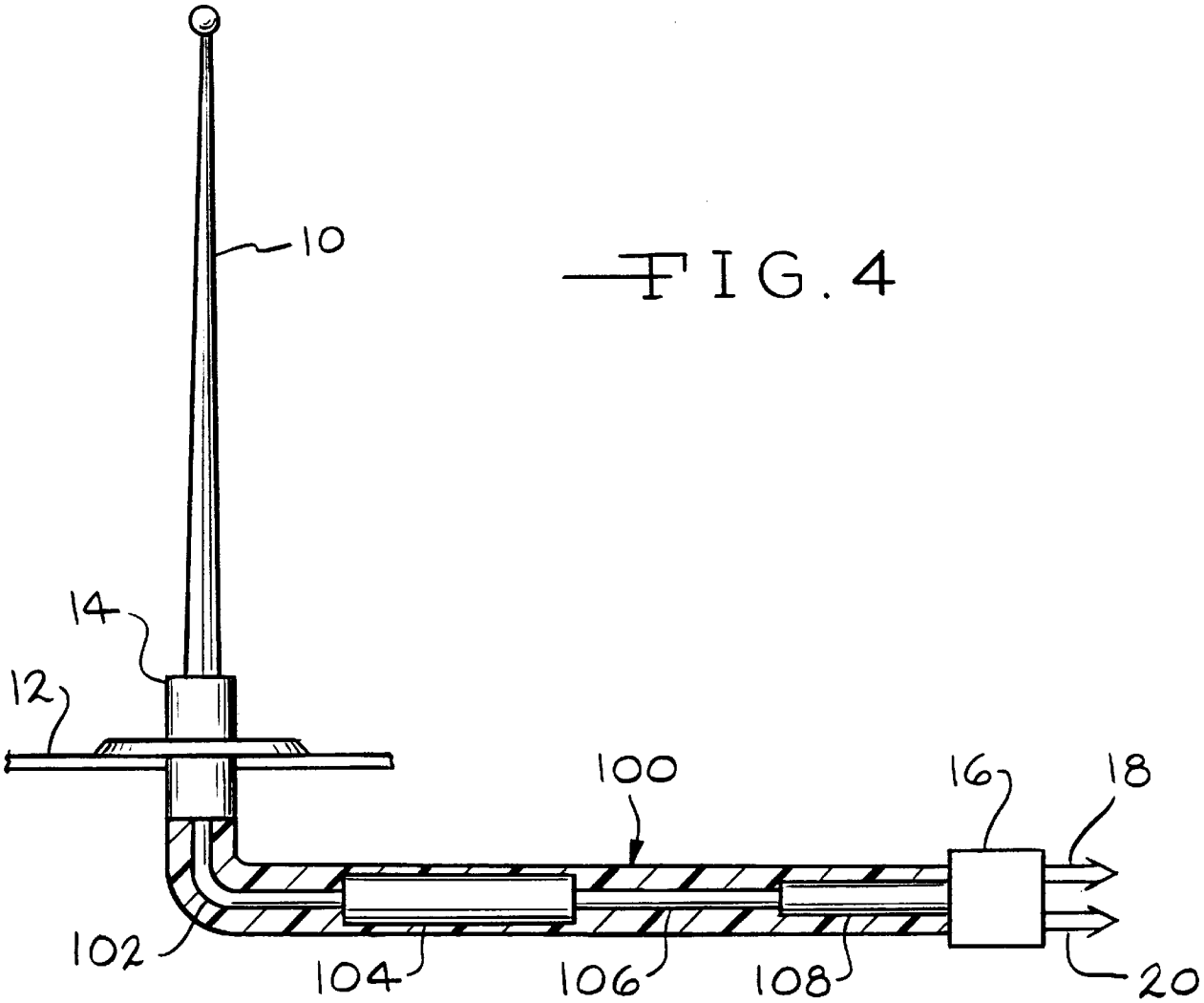
FIG. 4 is a schematic diagram of another form of broadband system with matching network according to the present invention.

FIG. 4 illustrates the manner in which the matching network of the present invention can be implemented using a microstrip transmission line instead of coax. The broadband matching network 100 of FIG. 4 utilizes a microstrip line of varying length and width. Using a Smith Chart the length and width of each of the strip line sections 102, 104, 106 and 108 is adjusted to obtain the best impedance match.

Another important consideration in the design of a broadband antenna system for vehicles is that in order to provide the bandwidth required (approximately 15% for a HiBand or VHF Band antenna system) the antenna must be resonant. It can be readily determined that a mast which can be set from 28 to 36 inches, which is the case for many vehicle antennas, is not resonant on the Hi Band (150 MHz to 174 MHz.) Since only a resonant antenna can be used with the desired bandwidth/SWR characteristic, some action must be taken to cause the antenna to appear resonant. The appearance of resonance is established according to the present invention by using a series reactive element as the first matching element. The nearer the antenna that matching is started the better the system bandwidth will be. In an effort to achieve maximum bandwidth the first series matching element such as an inductor must attach directly to the base of the antenna. Since in practice the antenna must be mounted to the support device, i.e. to the surface of a vehicle, the first inductor cannot be mounted directly to the end of the antenna. As a result the antenna base must be considered as a short length of coax. This coaxial section also must be controlled to maintain the desired broad bandwidth.

Figure 5:
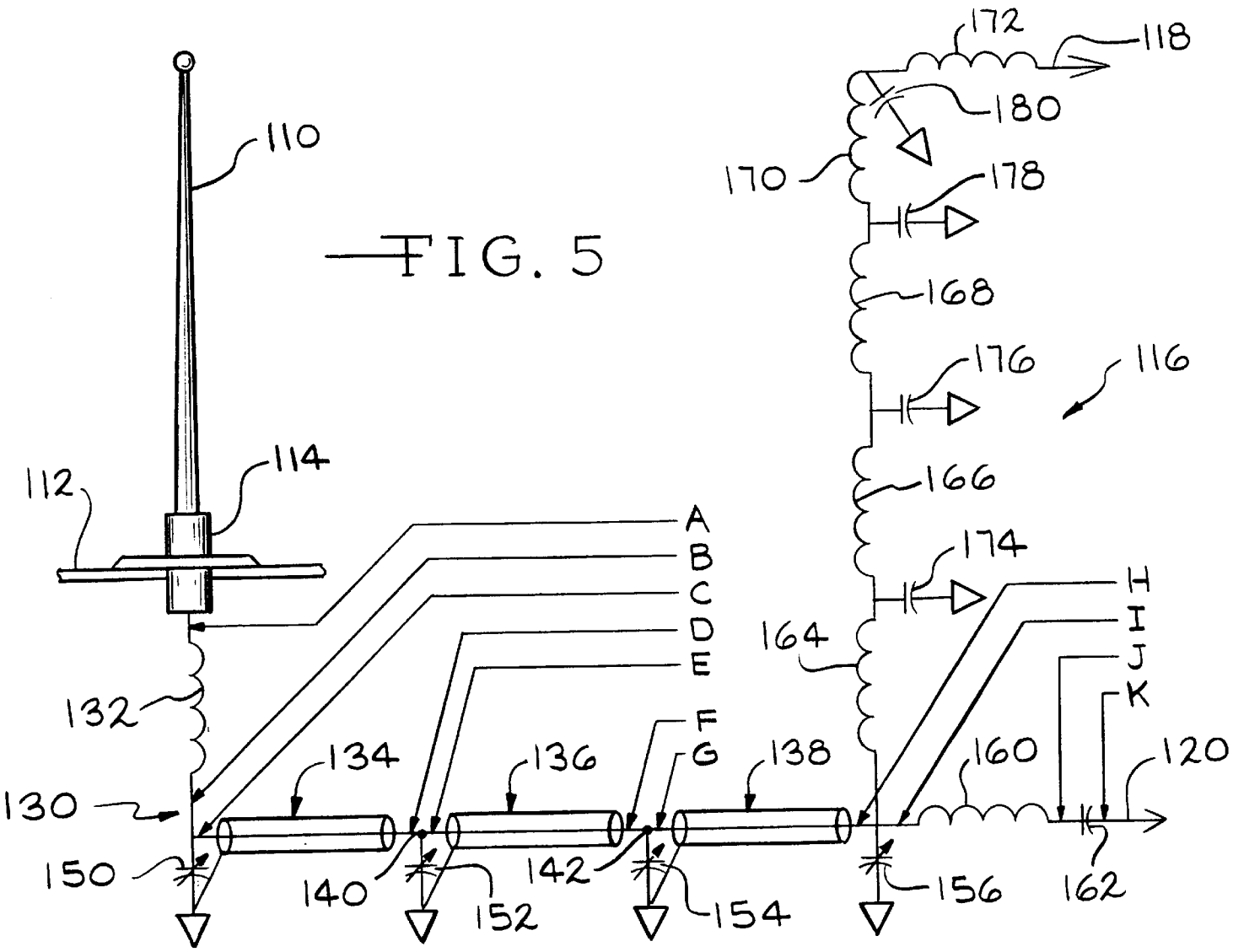
FIG. 5 is a schematic circuit diagram of a broadband antenna system for vehicles with matching network providing broadcast operation and VHF band operation according to the present invention.

A broadband antenna system including matching network for vehicles which provides AM/FM radio broadcast reception and HiBand or VHF (150–174 MHz) operation in the communications band over a bandwidth of about 24 MHz is shown in the schematic circuit diagram of FIG. 5 and in the views of FIGS. 6–9 which illustrate front and rear vehicle body mounting arrangements and bases for the antenna of the system. Referring first to FIG. 5, a standard vehicle mast or whip-type antenna 110 is mounted on an exterior surface 112 of the vehicle by means of a base 114. Antenna 110 is a solid stainless steel mast between 28 to 36 inches in length and is non-resonant in the Hi Band or VHF frequency range of 150 MHz to 174 MHz. Surface 112 can be a portion of the front or rear fender of the vehicle where antennas typically are mounted. Base 114, which will be described in detail presently in connection with FIGS. 6–9, provides a mechanical mounting of antenna 110 to vehicle surface 112 and provides electrical connection between the lower end of antenna 110 as viewed in FIG. 5 to the matching network of the antenna system.

The antenna system of FIG. 5 can be used with a standard broadcast entertainment radio providing both 530 KHz to 1.6 MHz AM reception and 88 to 108 MHz FM reception and with communication equipment such as a transceiver operating in the Hi Band or VHF frequency range of 150 MHz to 174 MHz. Isolation between the broadcast radio receiver and communications equipment is provided by a broadcast coupler generally designated 116 and which will be described in detail presently. Broadcast coupler 116 is connected between lines or conductors 118 and 120 leading to the broadcast receiver and communication equipment, respectively, which are located within the vehicle but not shown in FIG. 5. The broadcast radio and the communication equipment are coupled to antenna 110 by the broadband matching network according to the present invention and generally designated 130. A series reactive element 132 has one end connected electrically through base 114 in a manner which will be described in connection with FIGS. 6–9. Element 132 functions to bring antenna 110 closer to resonance in the 150 MHz to 174 MHz frequency band of interest, and in the present illustration series reactive element 132 comprises an inductor.

A plurality of transmission lines connected in series are included in matching network 130, and in the present illustration there are three series-connected transmission lines 134, 136 and 138 each comprising a section of coaxial cable. The center conductors of the adjacent lines 134 and 136 are joined by a stub junction designated 140 in FIG. 5, and similarly the center conductors of adjacent transmission lines 136 and 138 are joined by a stub junction 142. The outer conductors or shields of each of the transmission lines 134, 136 and 138 is connected to electrical ground or reference as shown in FIG. 5. The center conductor of the first transmission line 134 of the series is connected to the other end of the series reactive element or inductor 132.

The matching network 130 further comprises a plurality of matching elements, one of the matching elements being connected to the junction between series reactive element 132 and the first transmission line 134 of the series, another of the matching elements being connected to the end of the last transmission line 138 of the series and the remainder of the matching elements being connected to the junctions of the transmission lines 134, 136 and 138. In the present illustration, the matching elements are shunt reactive matching elements in the form of variable capacitors 150, 152, 154 and 156. Capacitor 150 is connected between the junction of inductor 132 and the center conductor of coax 134 and the electrical ground or reference. Capacitors 152 and 154 are connected between stub junctions 140 and 142, respectively, and ground. Capacitor 156 is connected between the center conductor of coax 138 and ground.

The magnitude of the series reactive element 132, the lengths of transmission lines 134, 136 and 138 and the magnitudes of the shunt matching elements 150, 152, 154 and 156 are selected to provide a relatively low standing wave ratio over a broad frequency range in a manner withstanding the full power of the communications equipment such as a transceiver. As a result, the matching network 30 of the present invention which is located within the vehicle with the broadcast radio and communication equipment enables the antenna 110 and base 114 on the exterior of the vehicle to maintain the visible appearance of a standard vehicle antenna.

The entertainment output for the broadcast radio and the communication output for the transmitter, transceiver or the like are obtained from the matched end of network 130. Broadcast coupler 116 includes a series tuned circuit comprising inductor 160 and capacitor 162 which isolates the broadcast radio from the transmitter/transceiver. Inductor 160 is connected to the junction of the center conductor of coax 138 and the last matching element, i.e., capacitor 156, of network 130. Capacitor 162 is connected to line 120 leading to the communications equipment. Broadcast coupler 116 also includes a low pass filter connected between the output of network 130 and line 118 leading to the broadcast radio which filter has a cutoff frequency halfway between the lowest operating frequency and the top end of the FM broadcast band (108 MHz). This prevents the transmitter/transceiver power from damaging the broadcast radio receiver. In the present illustration the low pass filter comprises the series combination of inductors 164, 166, 168, 170 and 172 and the shunt capacitors 174, 176, 178 and 180 connected between the junctions of the inductors and ground. The first inductor 164 in the series is connected to the junction of the center conductor of coax 138, and the last inductor in the series is connected to line 118 leading to the broadcast receiver. The components of broadcast coupler 116 can be contained, for example, in a relatively flat rectangular housing with connector fittings thereon for the two lines 118 and 120 and for the connection to network 130.

Figure 6:
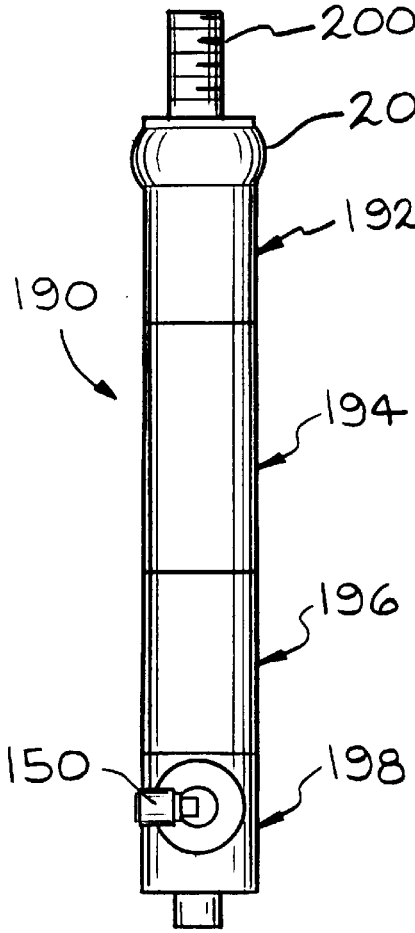
FIG. 6 is an elevational view of an antenna base and mounting arrangement for the system of FIG. 5 to mount the antenna on the front portion of a vehicle body.
Figure 7:
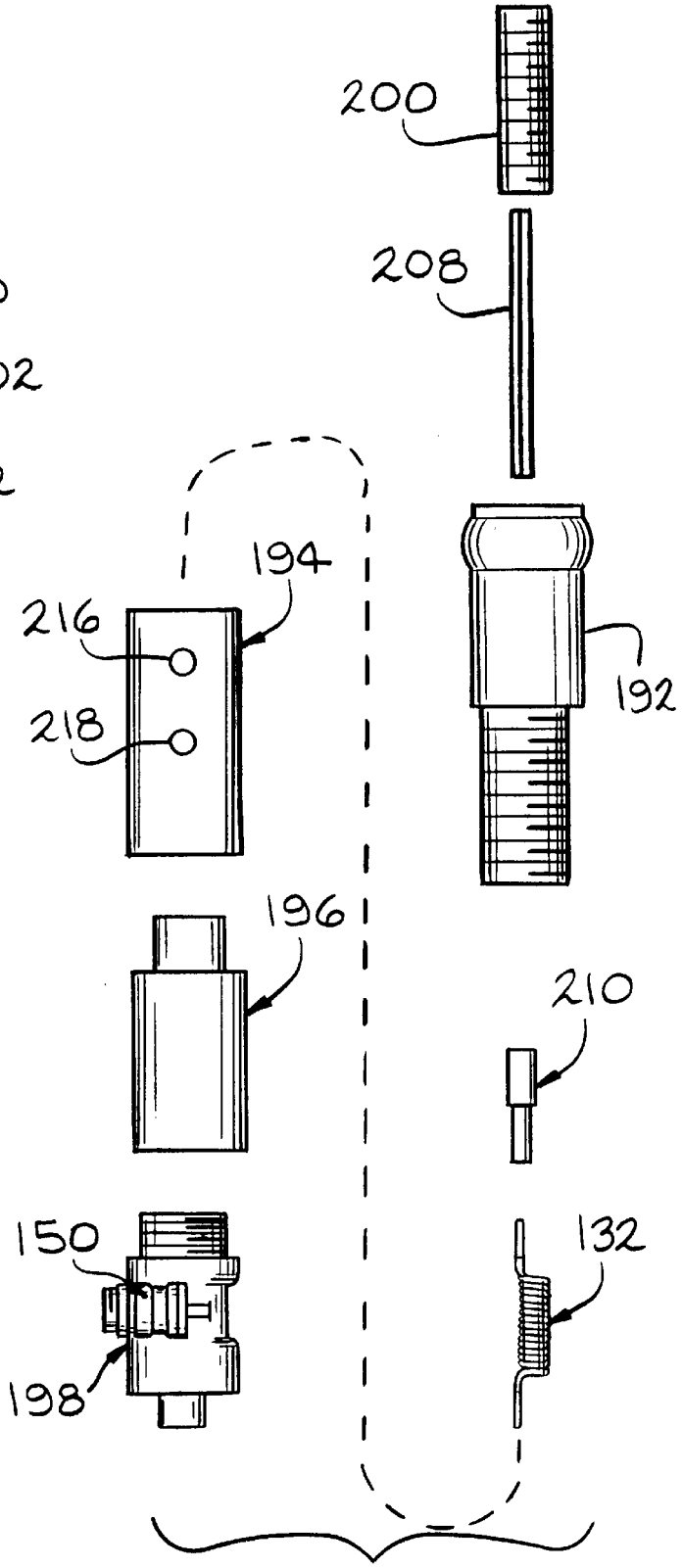
FIG. 7 is an exploded view of the arrangement of FIG. 6.

FIGS. 6 and 7 show a form of the base 114 adapted for mounting antenna 114 to a front fender of the vehicle. The base assembly, generally designated 190 in FIG. 6, includes an upper base section 192, lower base section 194, base adapter 196 and base stub junction 198. A threaded center conductor 200 extends from the end of upperbase section, and the lower end of the antenna mast 114 (not shown in FIGS. 6 and 7) threads onto conductor 200. The annular bulbous portion 202 snap-fits into a plastic or rubber fitting (not shown) secured to the exterior surface 112 of the vehicle, and the body of section 192 extends through a mounting hole in the vehicle body.

The exploded view of FIG. 7 illustrates the assembly of base 190 and the manner in which the series reactive element is connected electrically to the antenna 114. A stainless steel pin 208 is fitted snugly into a base in the end of the metal threaded center conductor 200 and is received in the hollow upper base section 192. A contact pin of brass or the like is press fit at one end to pin 208 and soldered at the other end to the series reactive element, i.e. inductor 132 in the network of FIG. 5. Lower base section 194 threads onto upper base section 192, adapter 196 fits into section 194 and stub junction 198 threads into adapter 196. The other end of inductor 132 is connected to stub junction 198, and the first matching element, i.e. capacitor 150 shown in FIG. 5 also is connected to stub junction 198. The end of the series transmission line path of the matching network, i.e. the end of coax 134 in the network 130 of FIG. 3, is connected to stub junction 198 at end fitting 214. A pair of holes 216, 218 in lower base section 194 receive fasteners which receive base assembly 190 to one end of a mounting bracket (not shown) the other end of which is secured to the inner frame or body structure of the vehicle.

Figure 8:
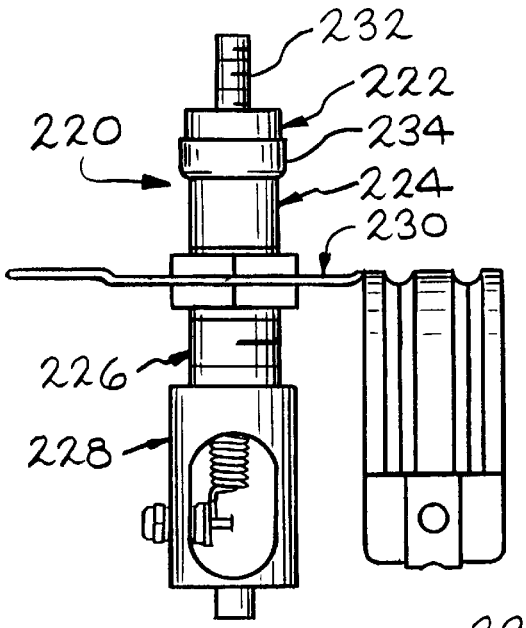
FIG. 8 is an elevational view of an antenna base and mounting arrangement for the system of FIG. 5 to mount the antenna on the rear portion of a vehicle body.
Figure 9:
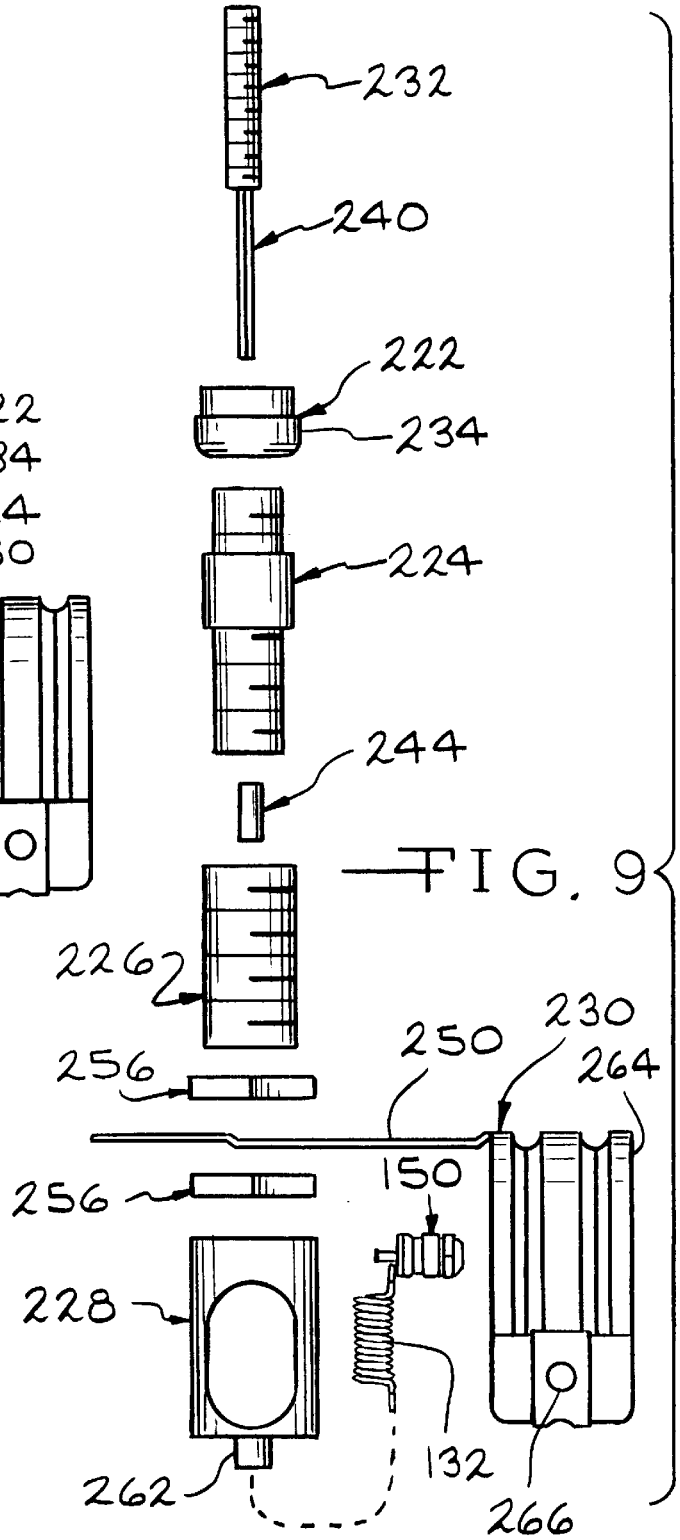
FIG. 9 is an exploded view of the arrangement of FIG. 8.

FIGS. 8 and 9 show a form of the base 114 adapted for mounting antenna 114 to a rear portion of the vehicle body. The base assembly, generally designated 22 in FIG. 8, includes an upper base section 222, lower base section 224, base adapter 226 and base stub junction 228. The base assembly 22 is supported by a mounting bracket 230 in a manner which will be described. A threaded center conductor 232 extends from the end of upper base section, and the lower end of the antenna mast 114 (not shown in FIGS. 8 and 9) threads onto conductor 232. An annular bulbous portion 234 snap-fits onto a plastic or rubber fitting (not shown) secured to the exterior surface 112 of the vehicle, and the body of section 224 extends through a mounting hole in the vehicle body.

The exploded view of FIG. 9 illustrates the assembly of base 220 and the manner in which the series reactive element is connected electrically to the antenna 114. A stainless steel pin 240 is fitted snugly into a bore in the end of the metal threaded center conductor 232 and is received in the hollow upper and lower base sections 222 and 224. A contact element 244 of brass or the like is press fit at one end to pin 240 and at the other end soldered to the series reactive element, i.e. inductor 132 in the network of FIG. 5. Upper base section 222 threads onto one end of lower base section 224, the opposite end of which threads into adapter 226. A flange 250 of bracket 230 is provided with an opening through which adapter 226 extends and is held therein by nuts 256. Stub junction 228 threads onto the end of adapter 226. The other end of inductor 132 is connected to stub junction 228, and the first matching element, i.e. capacitor 150 shown in FIG. 5, also is connected to the stub junction 228. The end of the series transmission line path of the matching network, i.e. the end of coax 134 in the network 130 of FIG. 3, is connected to stub junction 228 at the end fitting 262. A body portion 264 of mounting bracket 230 is provided with at least one hold 266 to receive a fastener by which it is secured to the inner frame or body structure of the vehicle.

By way of example, in an illustrative antenna system providing broadcast radio reception, both AM 530 KHz to 1.6 MHz and FM 88 to 108 MHz, and Hi Band or VHF operation of communication equipment covering the entire 24 MHz bandwidth of the 150 to 174 MHz range, antenna 110 is 28 inches in length, inductor 132 has a magnitude of 127.2 nanohenries, transmission lines 134, 136 and 138 are 50 ohm coax having lengths of 6.1 inch, 26.0 inches and 33.3 inches measured shield to shield, respectively, each of capacitors 150, 152, 154 and 156 has a magnitude of 14 picofarads, inductor 160 has a magnitude of 127.2 nanohenries, capacitor 162 has a magnitude of 8.2 nanohenries, inductors 164, 166, 168, 170 and 172 have magnitudes of 22.8, 96.2, 135.9, 135.9 and 22.8 nanohenries, respectively, and capacitors 174, 176, 178 and 180 have magnitudes of 24.0, 50.0, 60.0 and 60.0 picofarads, respectively.

Figure 10:
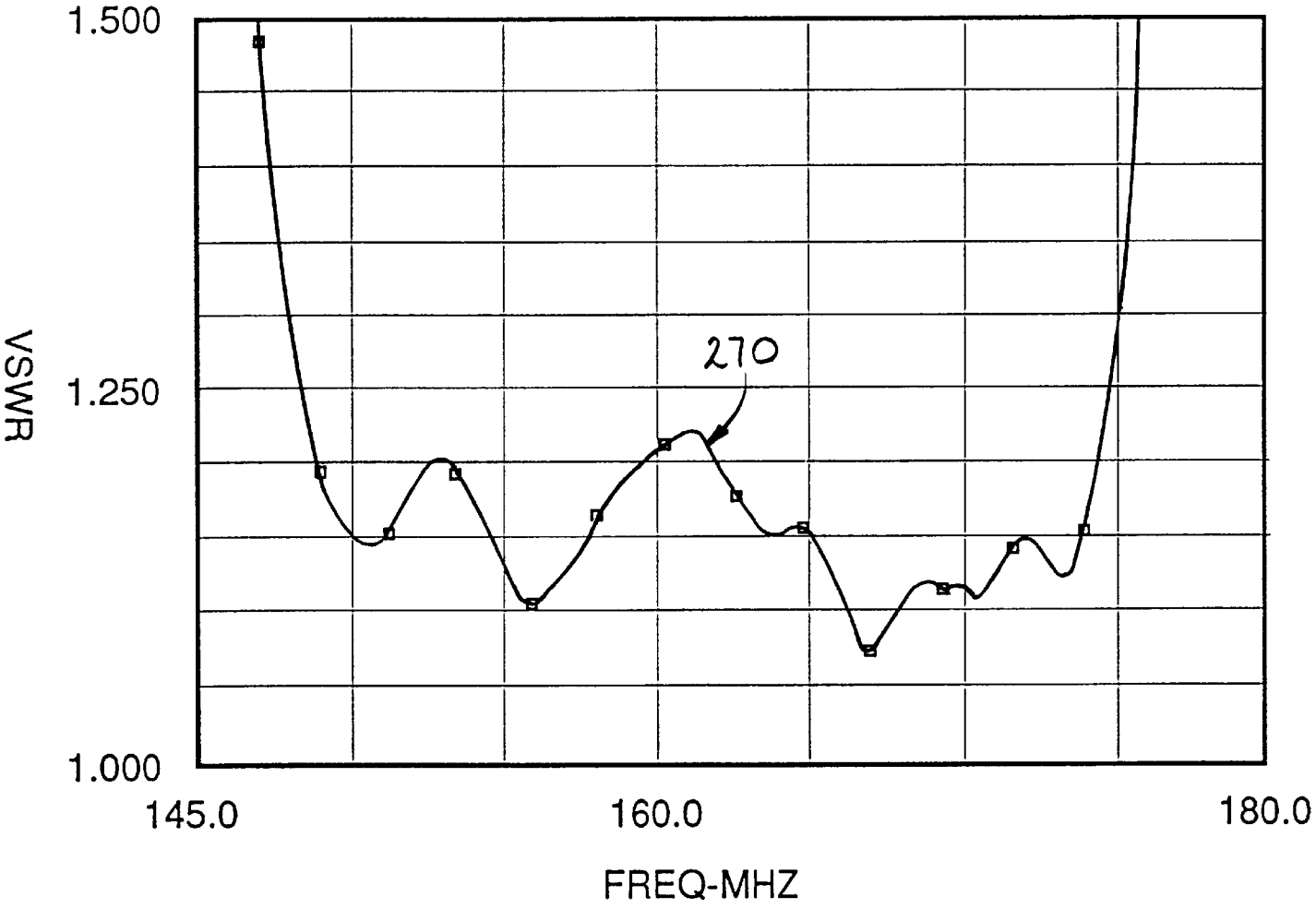
FIG. 10 is a graph in the form of a plot of the voltage standing wave ratio vs. frequency for the system of FIG. 5.

FIG. 10 is a plot of the voltage standing wave ratio (VSWR) vs. frequency for the foregoing illustrative antenna system. The advantages of relatively low VSWR and broadband operation in the 150–174 MHz frequency range are clearly demonstrated by the curve 270 in FIG. 10. In addition, the foregoing illustrative system has the advantages of power handling capability, no need for field tuning and the others discussed hereinabove. The VSWR plot of FIG. 10 was obtained at the output of the system, i.e. on the output side of capacitor 162, using the combination of a Hewlett Packard network analyzer model no. 8752A, GBIP interface bus by National Instruments and Zenon Pentium personal computer loaded with the Touchstone program described in connection with FIGS. 11A–11K.

FIGS. 11A–11K are Smith Charts illustrating the operation of matching network 130 in the antenna system of FIG. 5 and the selection of the magnitude of the components of network 130. The points in the system and network of FIG. 5 at which information is obtained for each of the Smith Chart plots of FIGS. 11A–11K are labelled by the arrows and corresponding letters A–K in FIG. 5. A Hewlett Packard network analyzer model no. 8752A is connected to each of the points A–K in FIG. 5 to obtain the information shown in the Smith Charts of FIGS. 11A–11K. The network analyzer is connected through a GBIP interface bus from National Instrument to a Zenon Pentium personal computer loaded with a microwave simulation and optimization program commercially available from EEsof, Inc. under the designation Touchstone 1 DOS Ver. 3,000.100.00 Config. (100 KGM 13E805DE 320000 400DCDE).

Figure 11A:
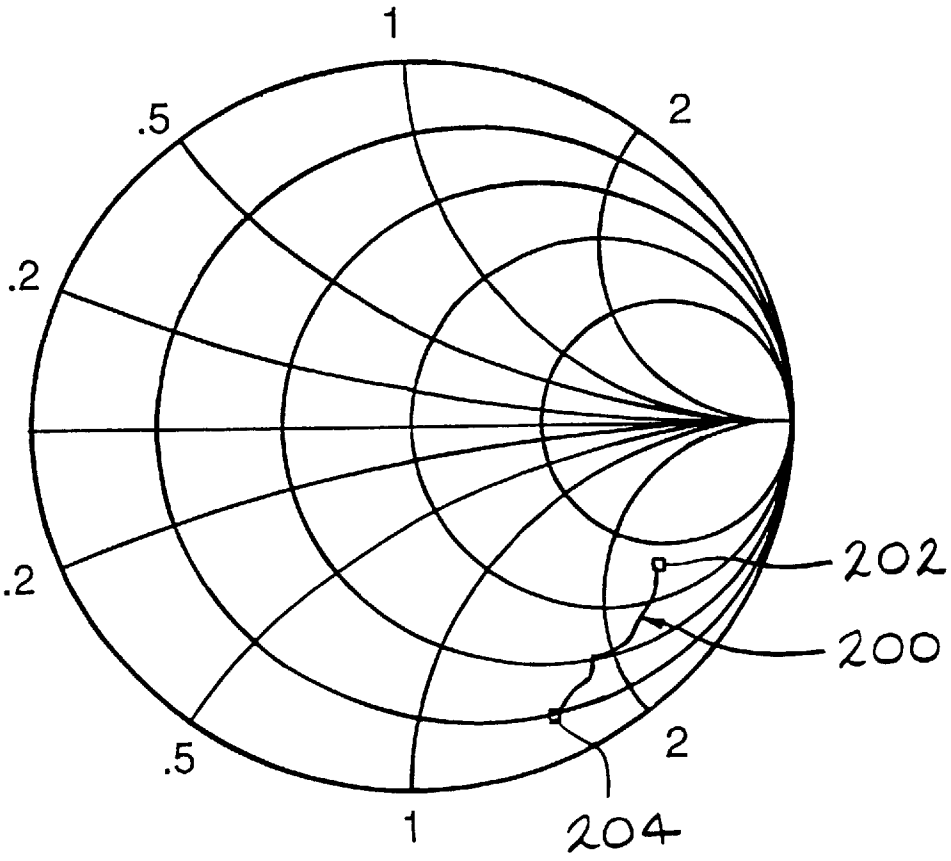
FIGS. 11A–11K are graphs including Smith Charts illustrating the operation of the system of FIG. 5.
Figure 11B:
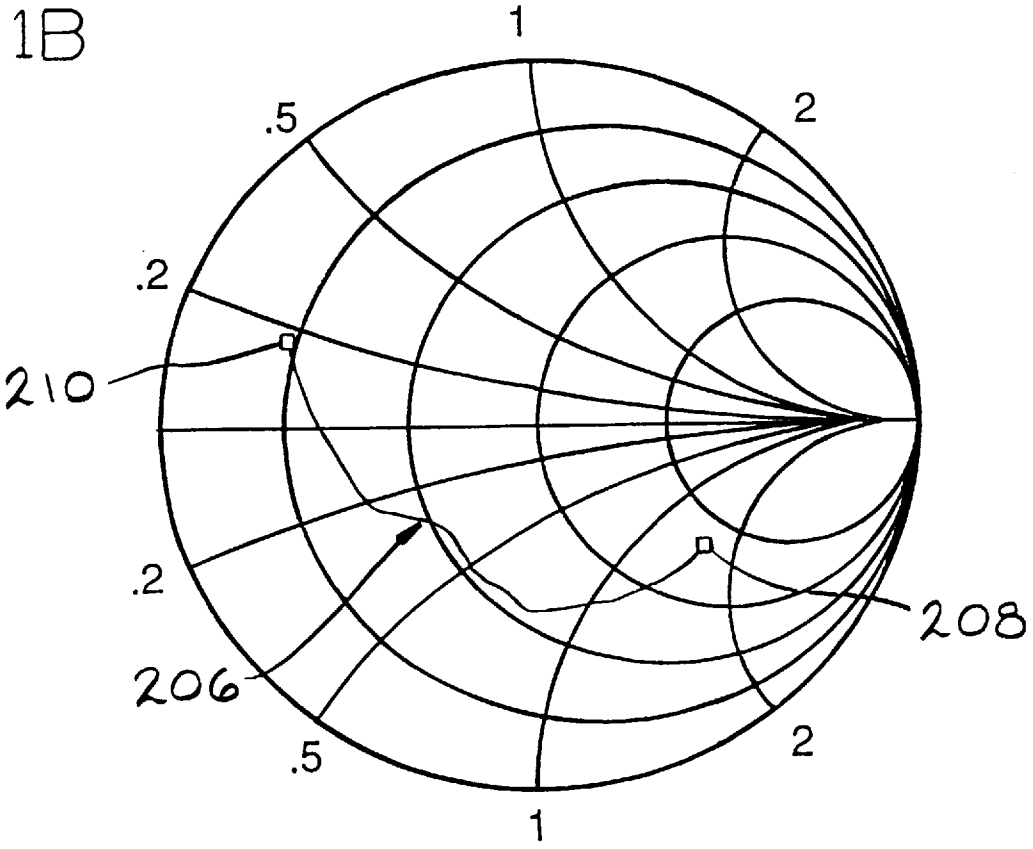
Figure 11C:
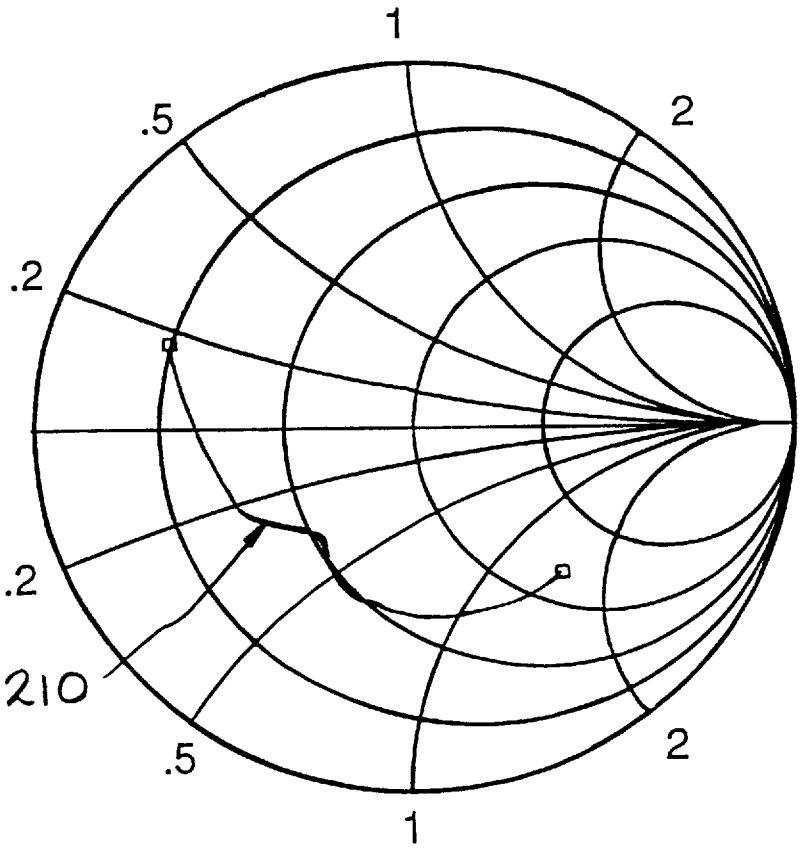
Figure 11D:
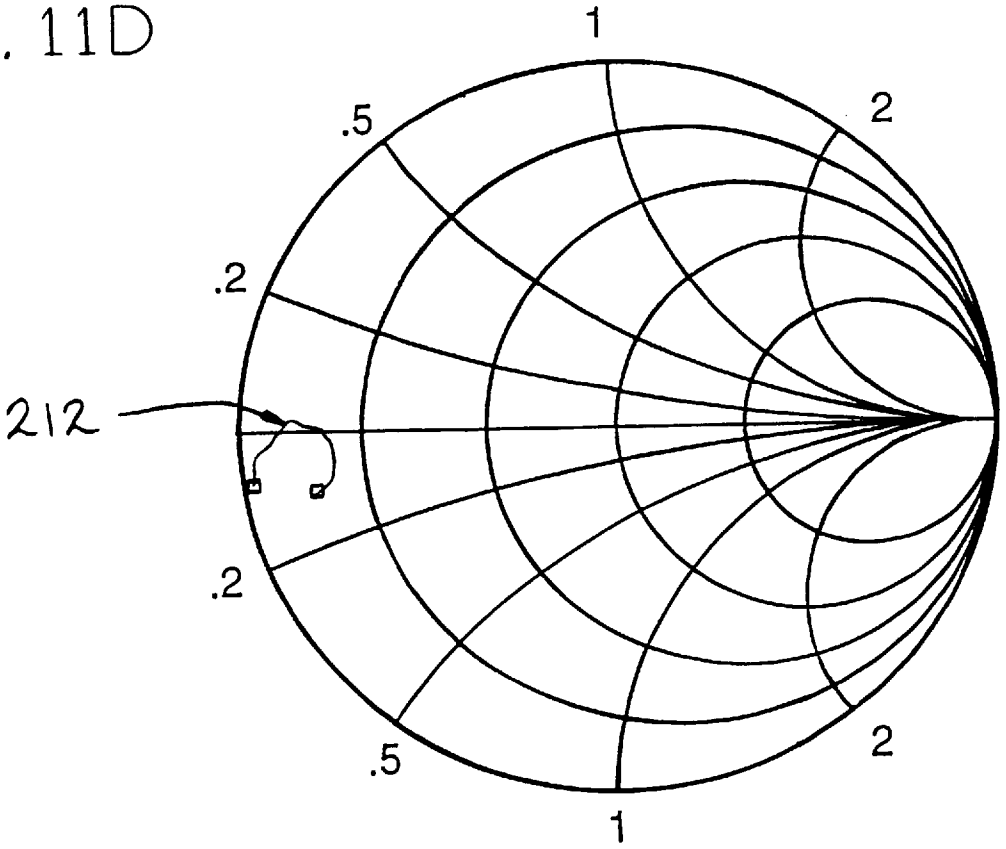
Figure 11E:
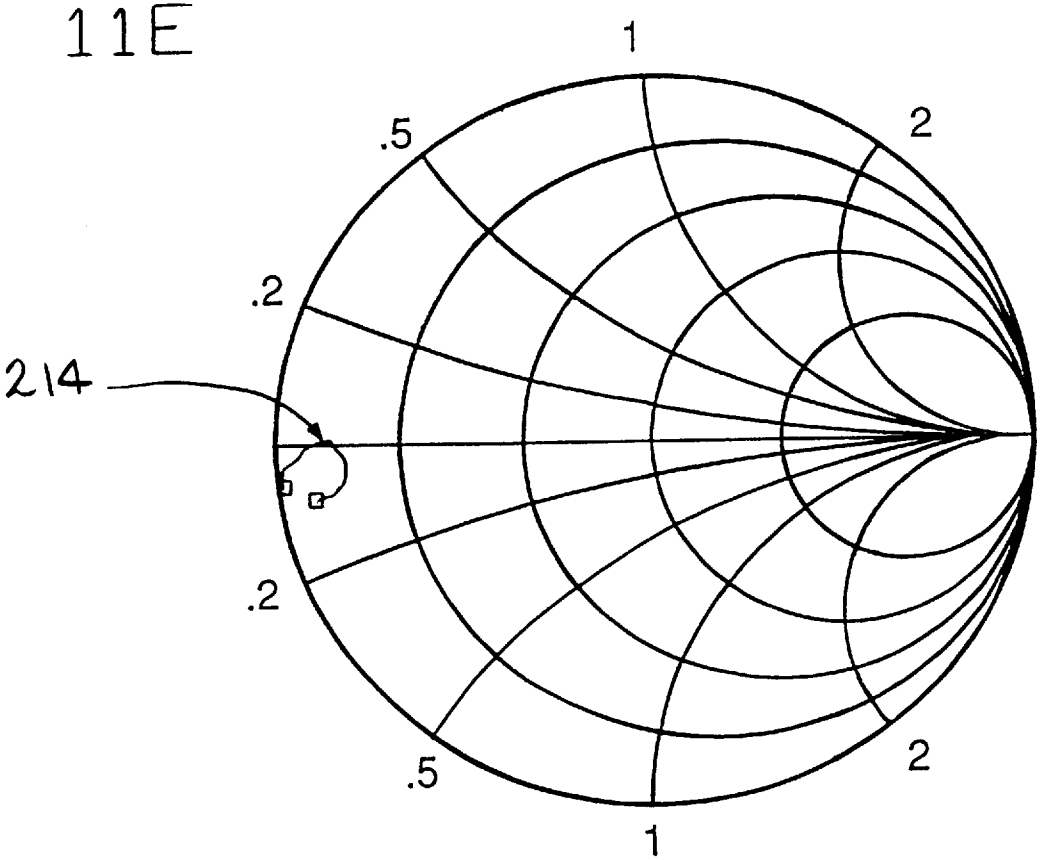
Figure 11F:
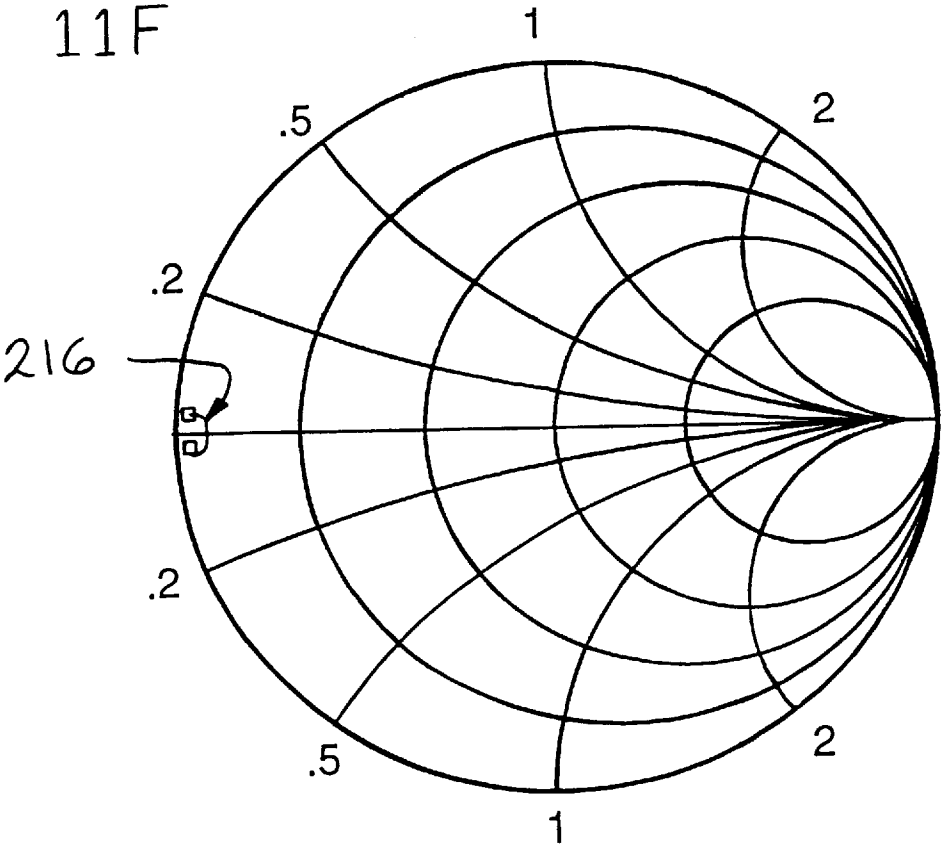
Figure 11G:
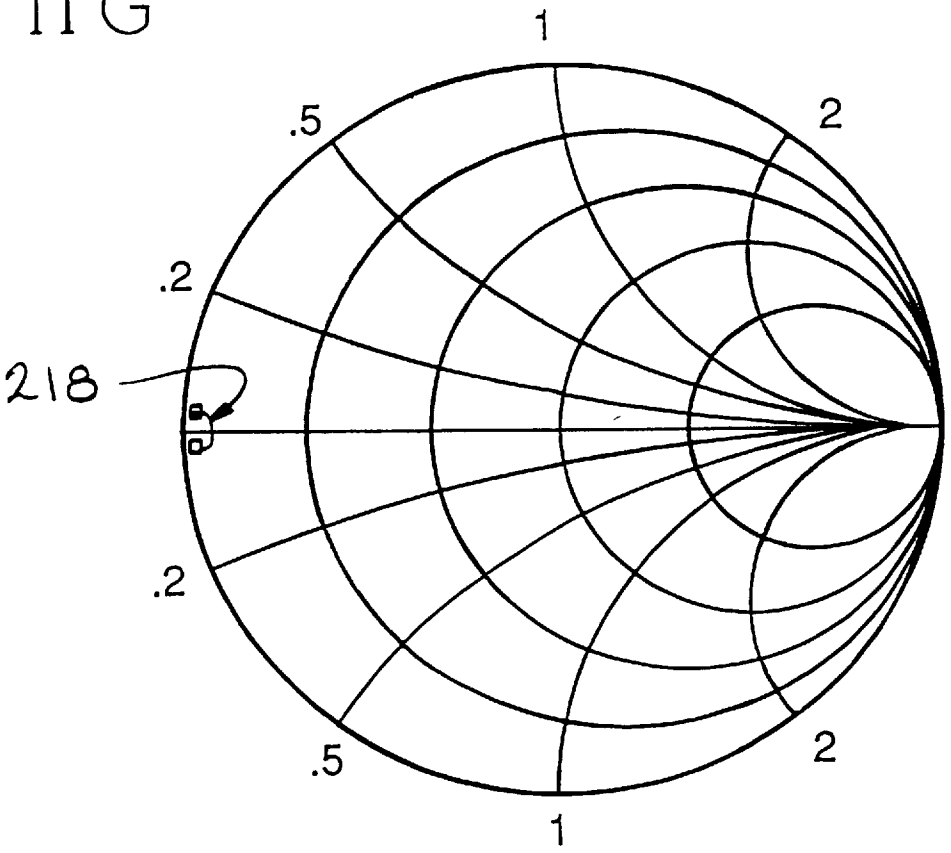
Figure 11H:
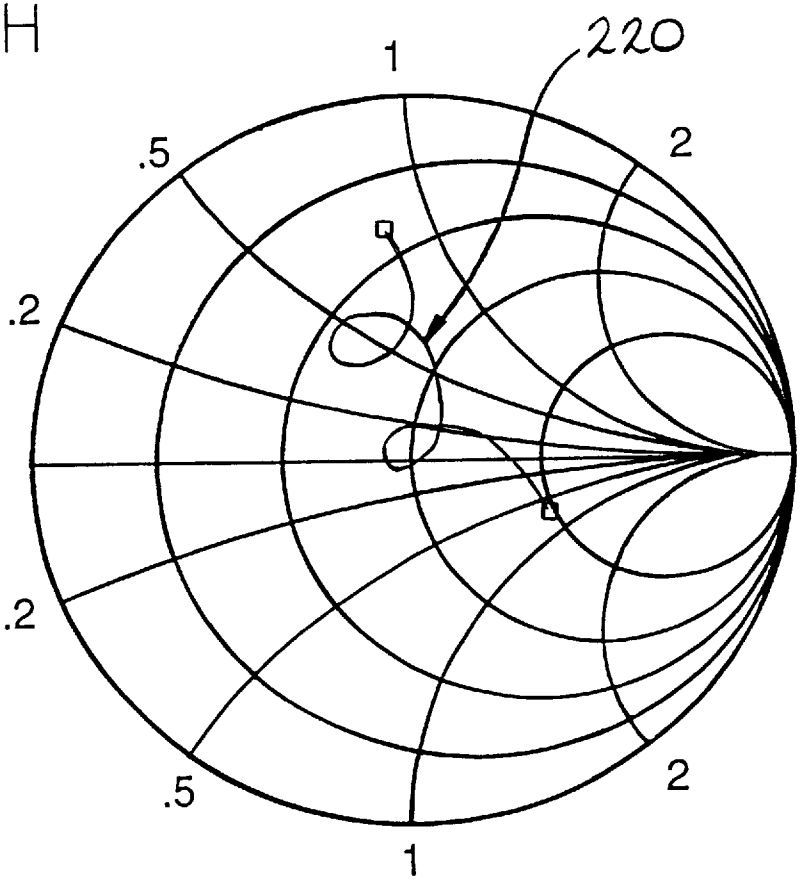
Figure 11I:
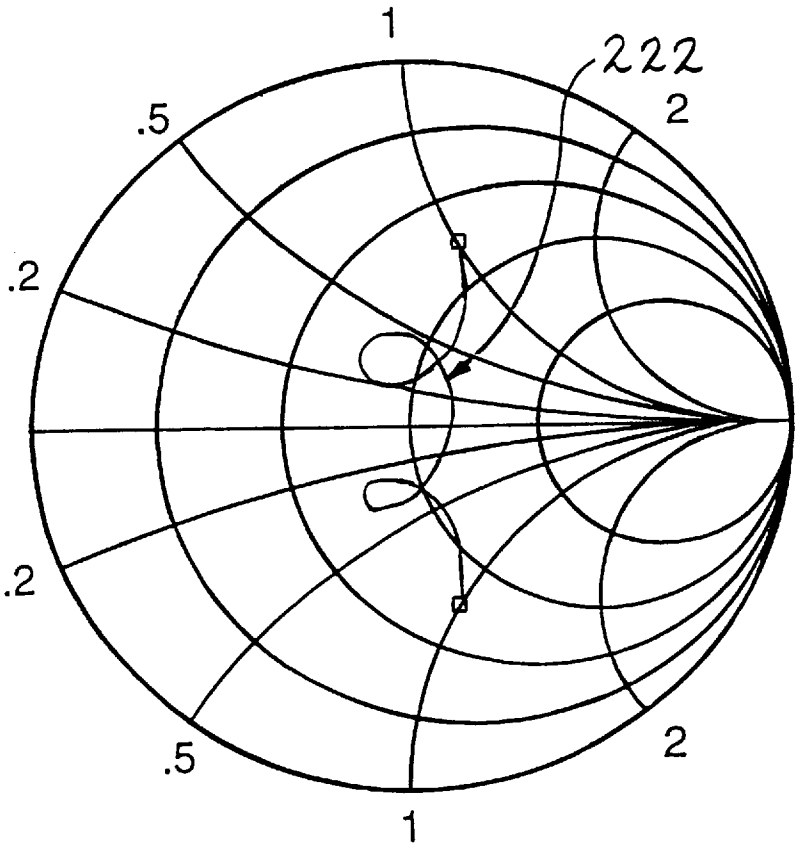
Figure 11J:
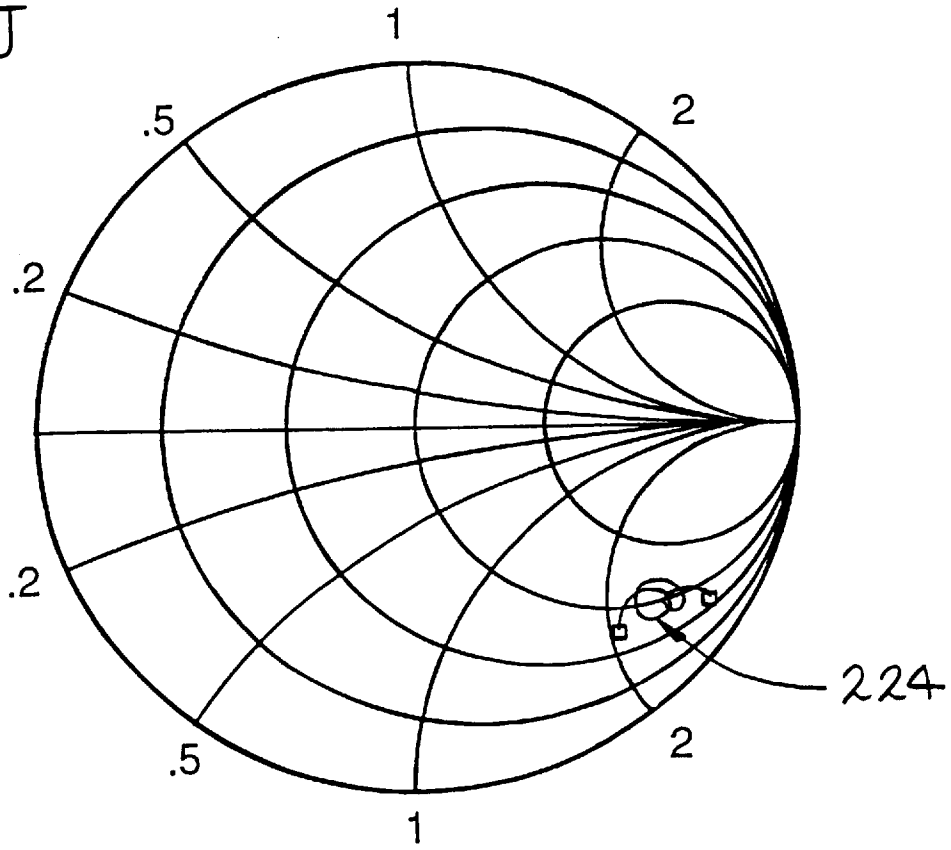

Referring first to FIG. 11A, the horizontal line is pure resistance increasing in magnitude from left to right with the values of r given below the chart and read by proceeding vertically to the horizontal axis, the upper portion of the chart corresponds to the positive reactance and the lower portion to the negative reactance component. Clockwise movement about the chart represents distance in wavelengths toward the generator, and counterclockwise movement represents distance in wavelength toward the load. The closed circles on the chart are loci of constant resistance or conductance and the open curves are loci of constant reactance or susceptance. The magnitudes around the upper portion of the chart are normalized to 50 ohms. The foregoing is the same for all the charts of FIGS. 11A–11K. The curve 200 in FIG. 11A is a trace of the S parameters between the low frequency point 202 of 130 MHz and the high frequency point 204 for point A in the circuit of FIG. 5 and generated by the Touchstone program, point A being for the antenna 110 and base 114. The S parameters include angle and magnitude values, real and imaginary. Similarly, in FIG. 11B curve 206 is a trace of the S parameter between the low frequency point 208 and the high frequency point 210 for point B in FIG. 5 which includes inductor 132 and the antenna base and mast. The magnitude of inductor 132 is selected by this process, the optimum magnitude being that which causes the Touchstone program to indicate that the best impedance match has been achieved. Trace 206 in FIG. 11B corresponds to that optimum impedance match.

Figure 11K:
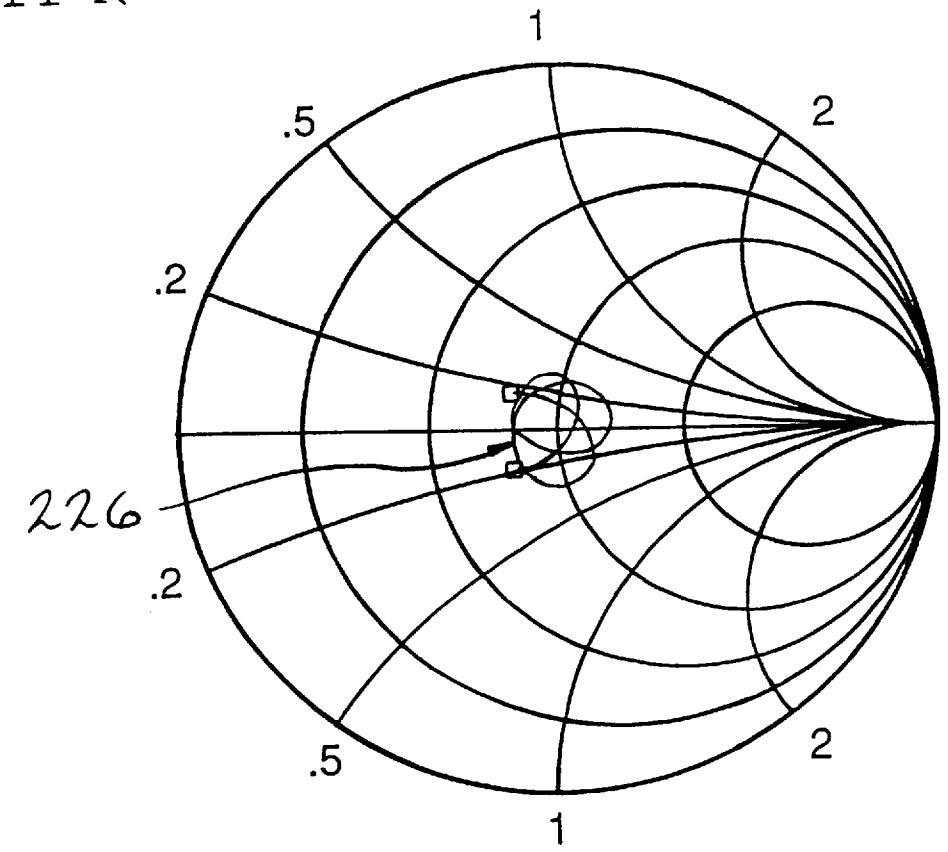

By proceeding through a similar operation at each of the points C–K in FIG. 5 the traces 210–226 are obtained. As one proceeds through the network point-to-point and observes the traces, it is seen that they approach and finally achieve, as shown in FIG. 11K, a location on the Smith Chart within a circle corresponding to a standing wave ratio of 2.0. The magnitudes of the capacitors and inductors and the lengths of the transmission lines in the matching network 130 are varied or adjusted until an indication is provided by the Touchstone program that an optimum impedance match has been obtained.

Multi band antenna systems can also be constructed using the network topologies according to the present invention. In order to provide multi band antenna systems where the first series reactive element is connected to the base of the antenna, a second element is also connected. The optimum network topology would involve the series element for the lower of the bands to be covered to be of a low pass nature, i.e., a series coil. The series element for the higher of the bands would use a high pass device, i.e., a capacitor. If a third band is to be provided for the coupling must be band pass in nature, i.e. a series tuned circuit.

Figure 12:
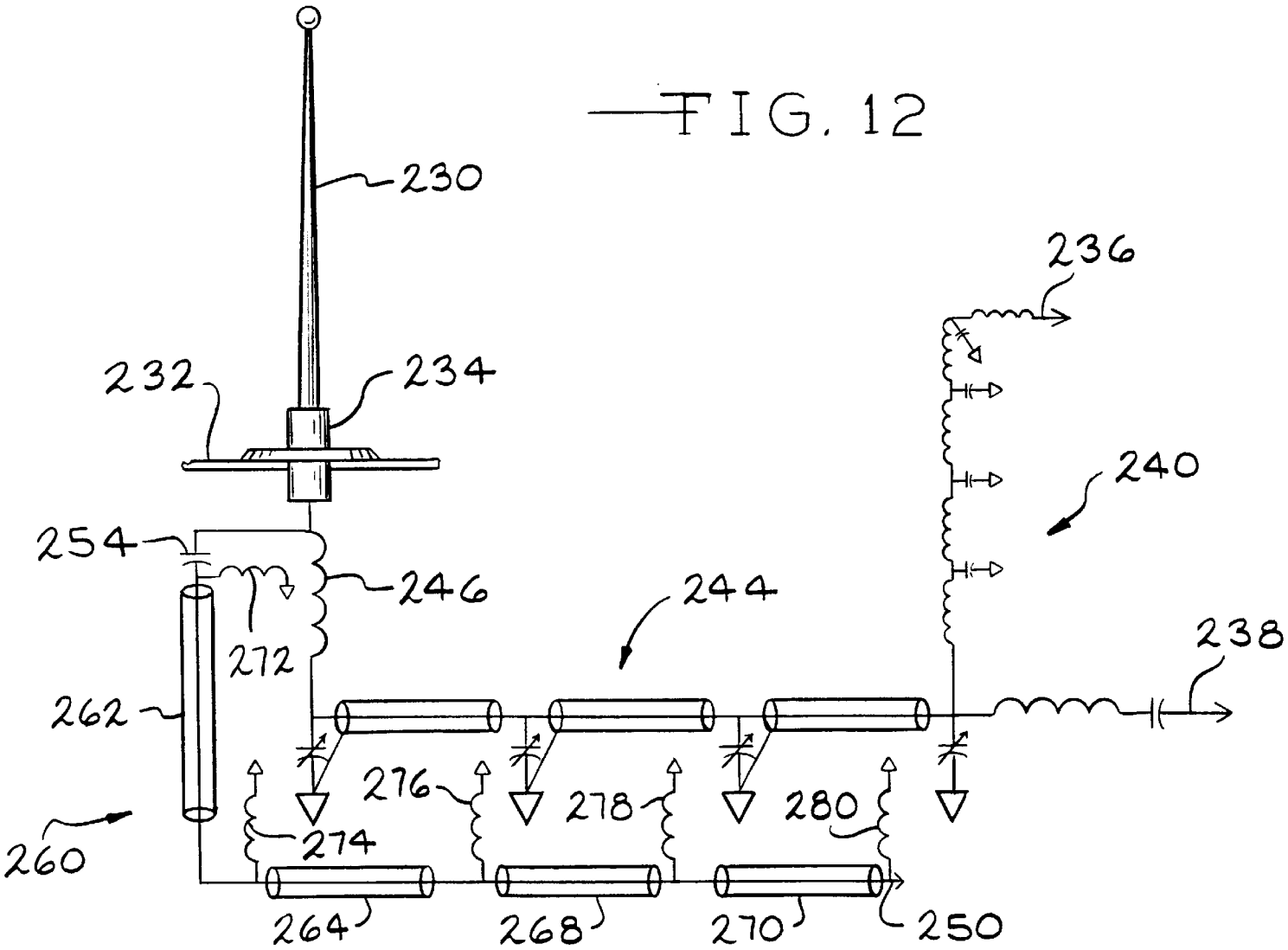
FIG. 12 is a schematic circuit diagram of a broadband, multiband antenna system for vehicles according to the present invention.

A multiband antenna system according to the present invention is shown in FIG. 12. A standard vehicle antenna 230 is mounted on a vehicle surface 232 by a mast 234 as in the embodiment of FIGS. 5–9. A broadcast radio and low frequency transmitter or transceiver are connected by lines 236 and 238, respectively, to a broadcast coupler 240 in a manner similar to the system of FIG. 5. A matching network 244 similar to matching network 130 in the system of FIG. 5 and a series reactive element 246 are provided between broadcast coupler 240 and the antenna 230. Element 246 is an inductor because this portion of the system operates in the lower band. A transmitter/transceiver operating in the higher band is connected to line 250. For coupling to this higher band communication equipment there is provided a series reactive element in the form of capacitor 254. Both inductor 246 and capacitor 254 are connected electrically to the end of the antenna mast, for example both would be soldered to connector element 210 in the mounting arrangement of FIG. 7. The high band matching network 260 includes a plurality of series-connected transmission lines 262, 264, 268 and 270 joined by stub junctions and a plurality of shunt matching elements in the form of inductors 272, 274, 276, 278 and 280 connected between the stub junctions and electrical ground. Matching network matches the impedance of the high band communications equipment to that of the antenna and mast.

The antenna system with matching network according to the present invention is further illustrated by the following examples wherein plots of VSWR vs. frequency for various embodiments of the invention are compared to a VSWR vs. frequency for a lumped parameter antenna matching network. A 1995 model Ford Taurus antenna was mounted on a ground plane comprising a sheet of aluminum 4 feet by 8 feet at a location about 3 inches from the long edge and mid-way between the short edges to simulate mounting on the fender of a car. The ground plane and antenna were identical for each of the examples.

In the first example, a prior art lumped parameter matching network as shown in FIG. 13 was connected to the antenna 300 and ground plane 302 as shown. Inductors 310, 312, 314 and 316 had magnitudes of 122.64, 33.76, 50.71 and 126.43 nanohenries, respectively. Capacitors 318, 320, 322 and 324 had magnitudes of 53.15, 98.94, 34.16 and 18.63 picofarads, respectively. The inductors and capacitors had Q factors of 120 and 400, respectively, valid at 162 MHz. Capacitor 326 and inductor 328 had magnitudes of 138.46 picofarads and 80.58 nanohenries, respectively. The system broadcast coupler was connected to the junction of capacitors 324 and 326. The measurements of VSWR vs. frequency were taken at the output designated 330 by the Hewlett Packard network analyzer previously identified coupled through the GBIP interface has to the Zenon Pentium computer loaded with the previously identified Touchstone program which controls the network analyzer to obtain the information which is presented by curve 332 in FIG. 14. The same combination of network analyzer, bus, computer and program was used in all the examples.

Figure 15:
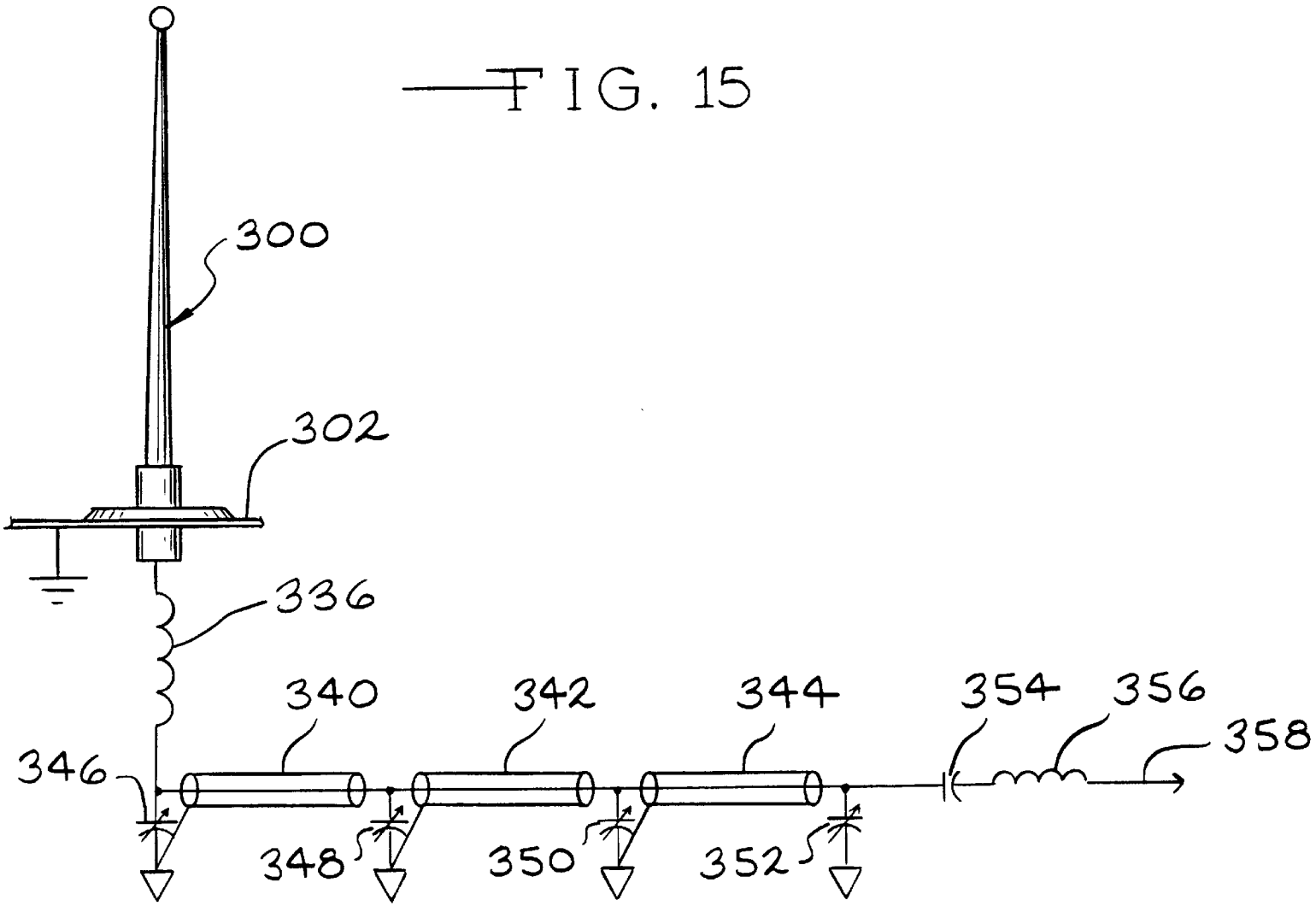

In the second example, a matching network according to the present invention and similar to that shown in FIG. 5 was connected to the antenna 300 and ground plane as shown in FIG. 15. Inductor 336 had a magnitude of 111.42 nanohenries, transmission lines 340, 342 and 344 had inner diameters of 0.057 inch, outer diameters of 0.19 inch, lengths of 4.53 inches, 11.05 inches and 20.50 inches, respectively, equivalent resistances of 2.1, loss tangents of 0.002 and surface resistivity of 1.0, and capacitors 346,348, 350 and 352 had magnitudes of 63.68, 91.89, 7.07 and 18.44 picofarads, respectively. Capacitor 354 and inductor 356 had magnitudes of 8.78 picofarads and 145.21 nanohenries, respectively. The measurements of VSWR vs. frequency were taken at the output designated 358 in the same manner as the previous example to provide the curve 360 in FIG. 16.

Figure 14:
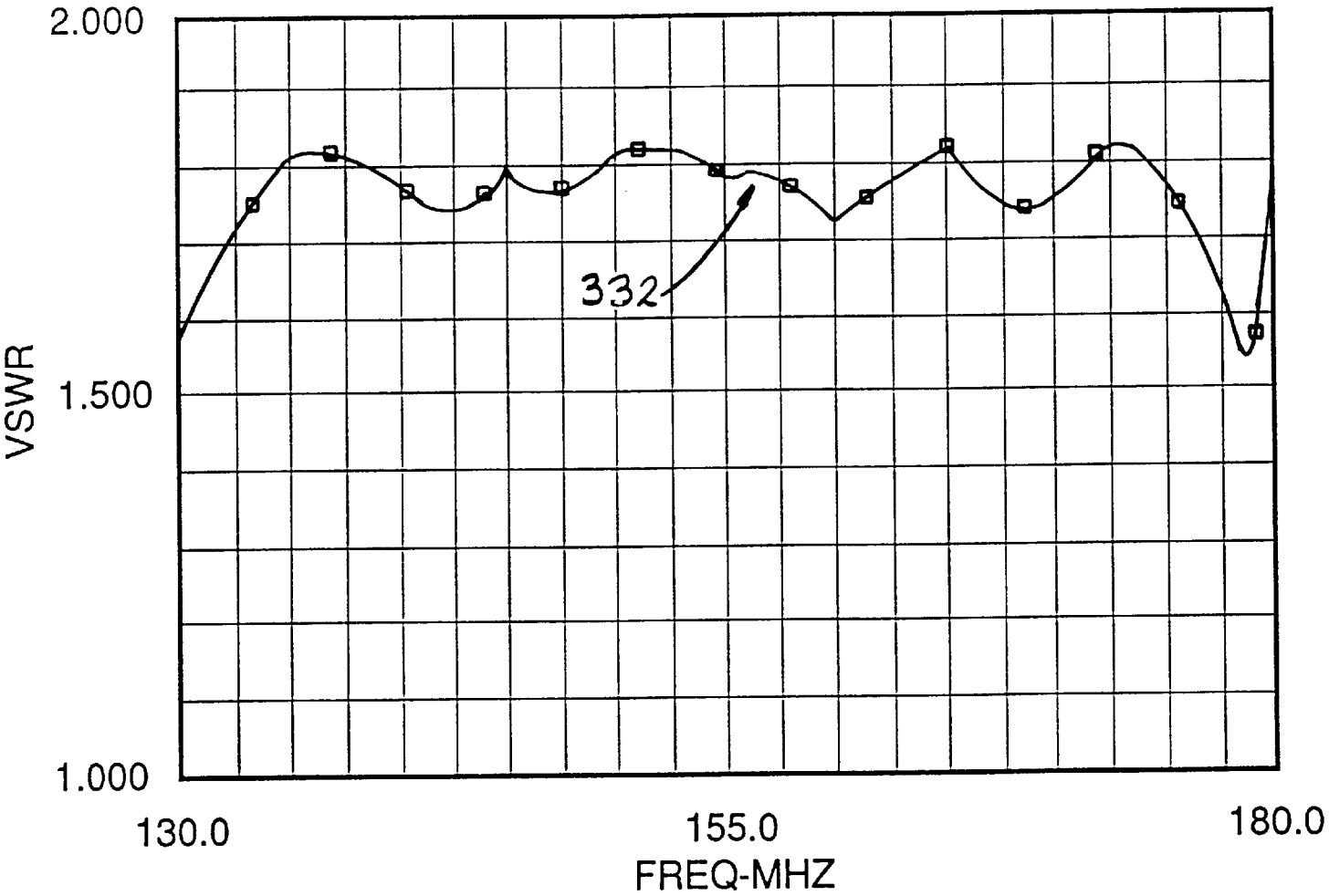
FIG. 14 is a graph including a plot of voltage standing wave ratio vs. frequency for the network of FIG. 13.
Figure 16:
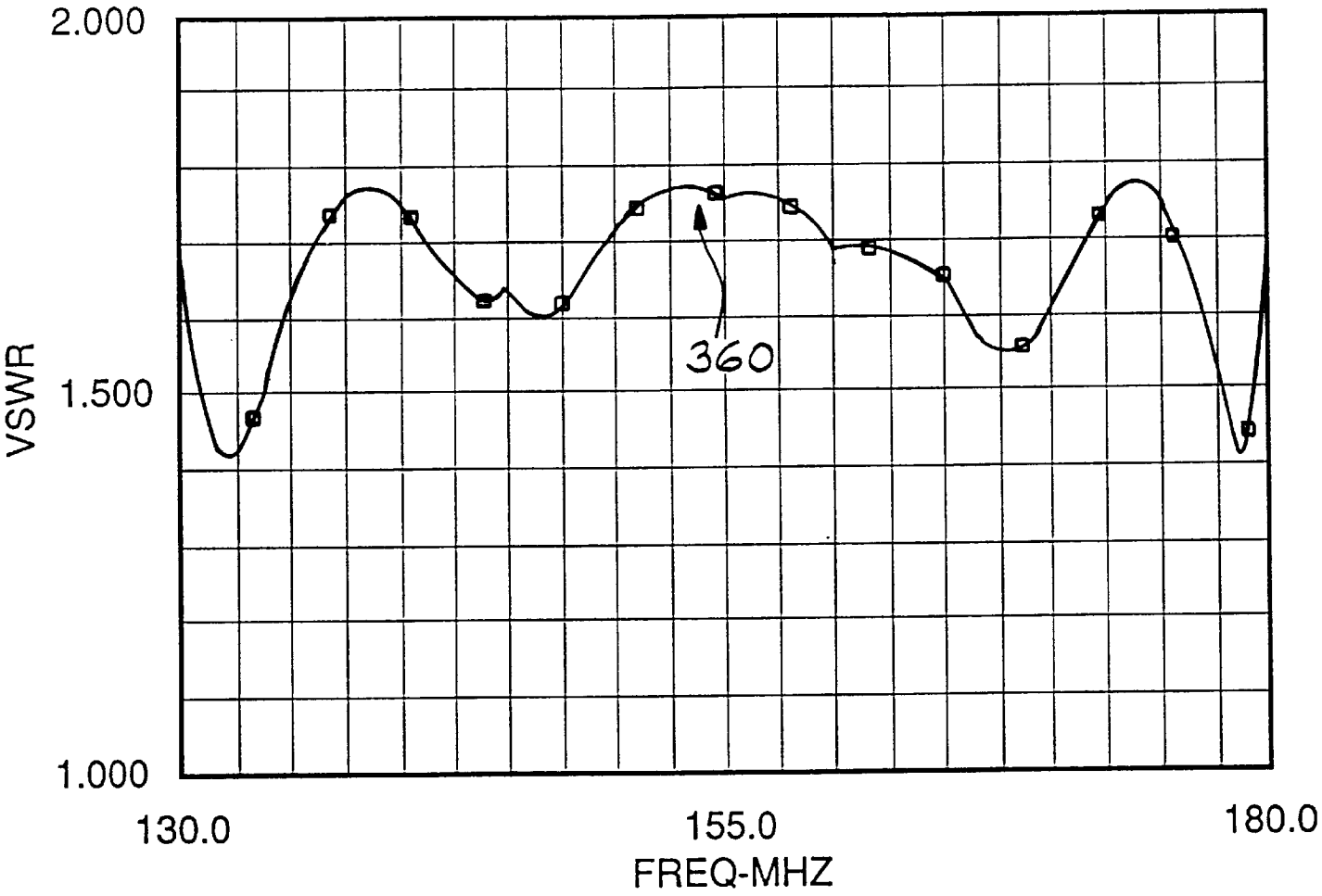

Curve 360 in FIG. 16 illustrates the improvement of lower VSWR over the broad frequency range of 130–180 MHz in the antenna system with matching network according to the present invention, as compared to the prior art lumped parameter matching network illustrated in FIGS. 13 and 14. In this connection, it is important to reiterate that a lumped parameter network of the type shown in FIG. 13 cannot be located at the base of the antenna due to space constraints within the vehicle. Furthermore, power dissipation and resulting heat is concentrated in the discrete lumped parameter components and their connections which can cause damage at the high power levels associated with the communications equipment as pointed out hereinabove.

Figure 17:
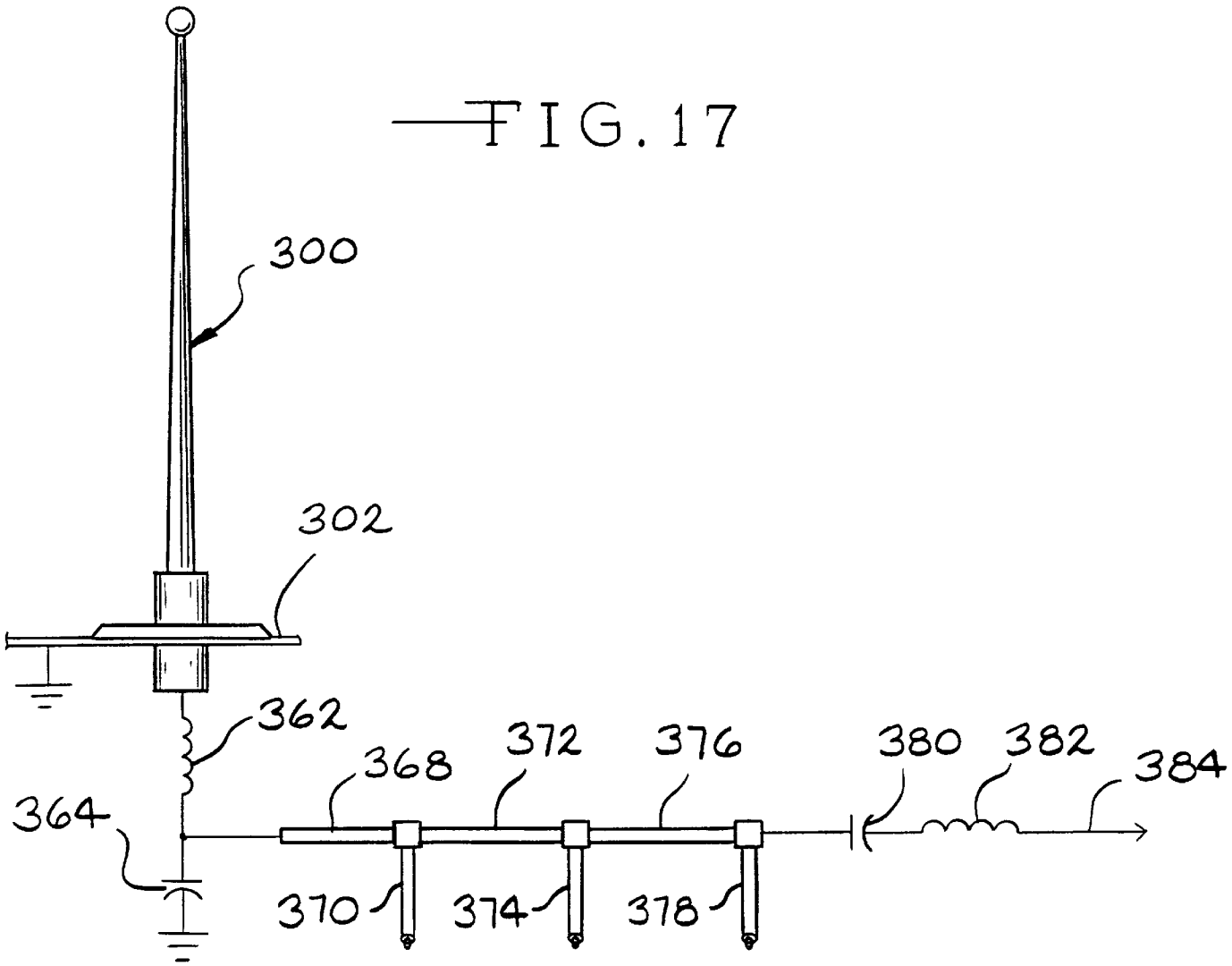

In the third example, a matching network according to the present invention and similar to the embodiment of FIG. 1 was connected to the antenna 300 and ground plane as shown in FIG. 17. Inductor 362 had a magnitude of 114.68 nanohenries, capacitor 364 had a magnitude of 48.61 picofarads, each of the transmission lines had an inner diameter of 0.057 inch, an outer diameter of 0.19 inch, equivalent resistance of 2.1, loss tangent of 0.002 and surface sensitivity of 1.0. Transmission lines 364, 368, 370, 372, 374, 376 and 378 had lengths of 5.31, 10.18, 26.32, 17.74, 2.34 and 8.16 inches, respectively. Capacitor 380 and inductor 382 had magnitudes of 11.83 picofarads and 93.60 nanohenries, respectively. The measurements of VSWR vs. frequency were taken at the output designated 384 in the same manner as the previous example to provide the curve 386 in FIG. 18.

Figure 18:
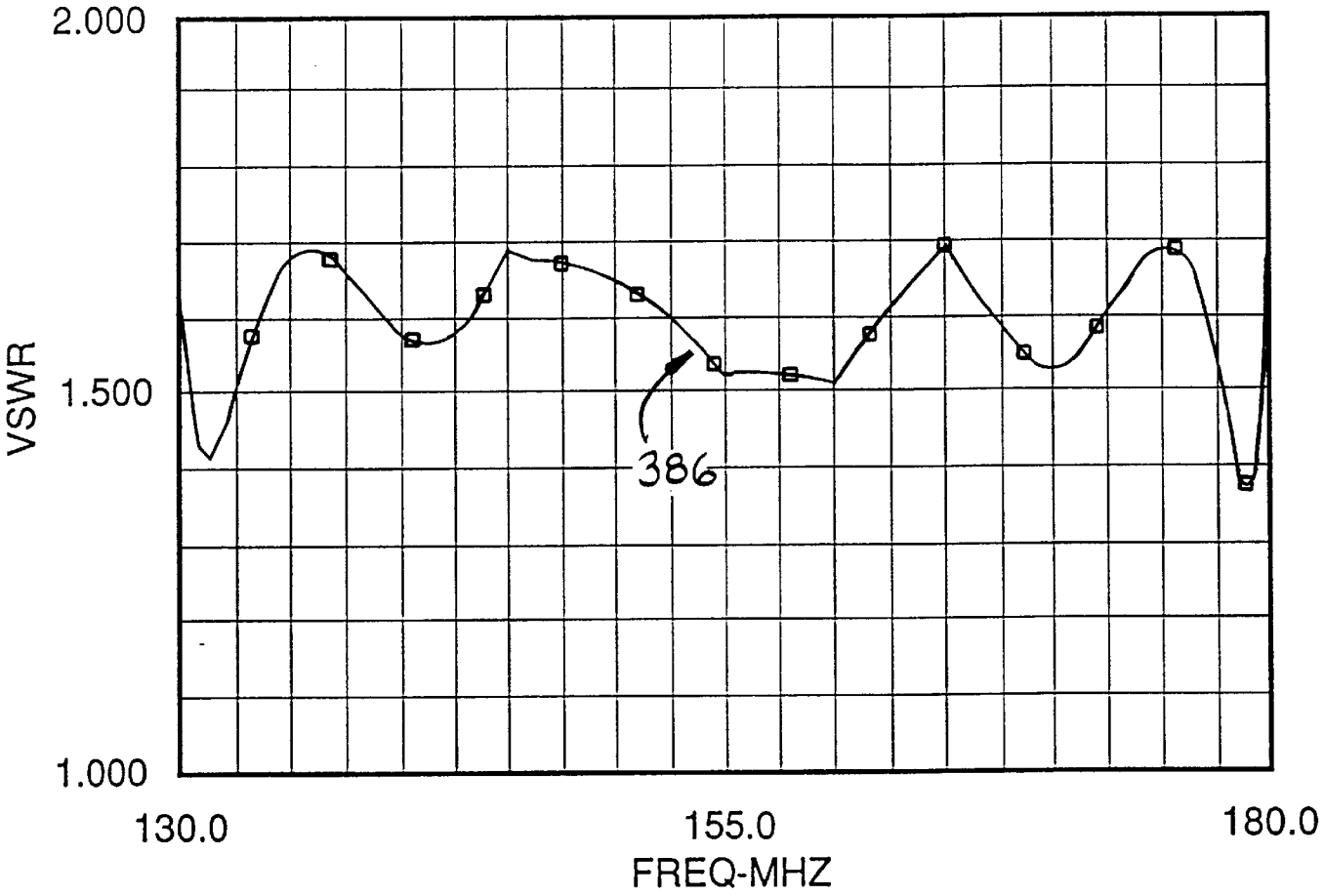
Figure 19:
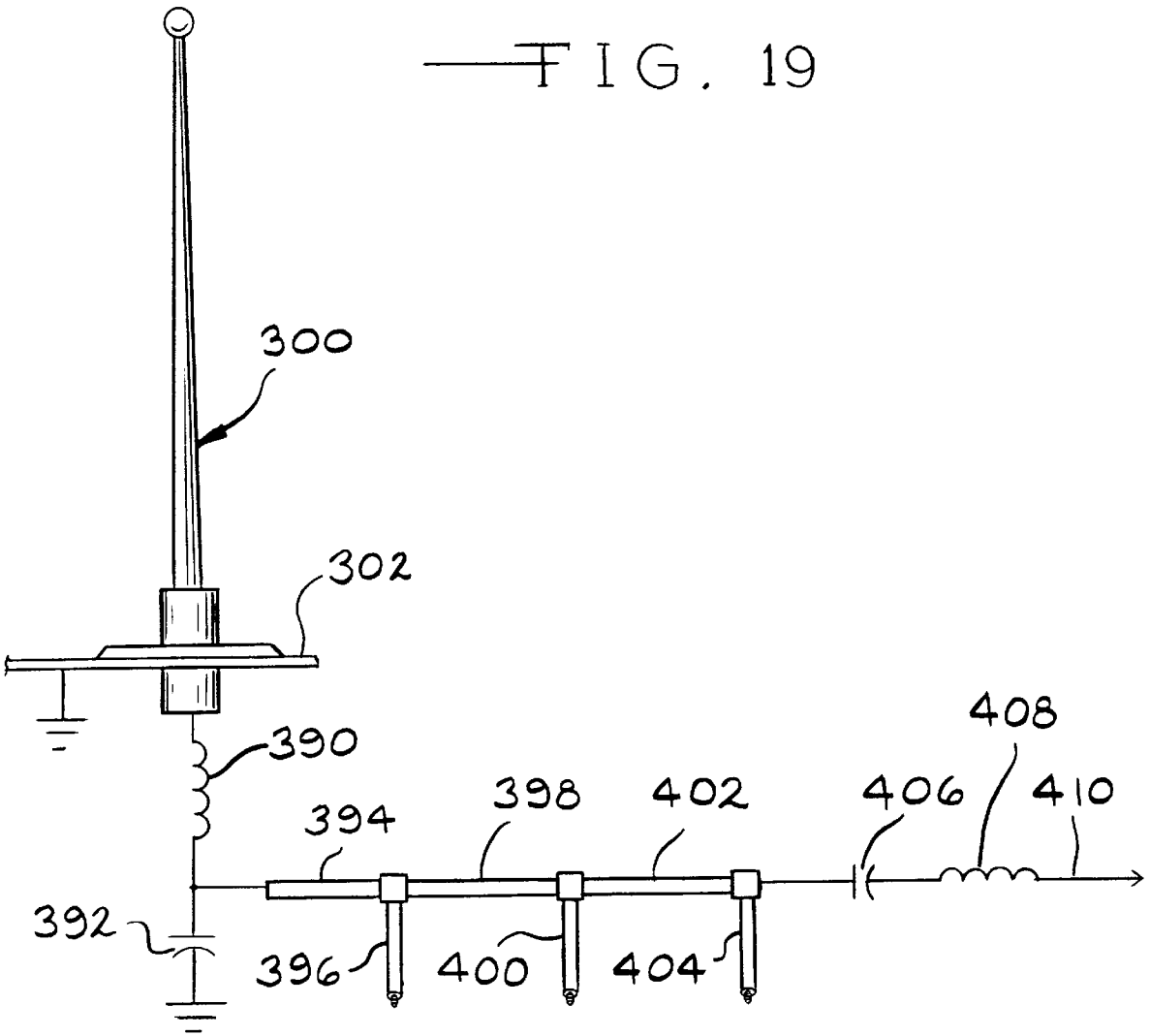

Curve 386 in FIG. 18 illustrates the further improvment of even lower VSWR over the broad figuring range of 130–180 MHz in the antenna system with matching network according to the embodiment of the present invention.

In the fourth example, the matching network was similar to that of the thrd example but the impedance of the series connected transmission lines was varied by changing of the inner diameter. In particular, referring to FIG. 19, inductor

390 had a magnitude of 78.90 nanohenries, and capacitor 392 had a magnitude of 12.55 picofarads. All of the transmission lines had the same outer diameter, equivalent resistence and surface sensitivity as the transmission lines in the previous example. The shunt transmission lines 396, 400 and 404 each had inner diameter of 0.057 inch. The series connected transmission lines 394, 398 and 402 had inner diameters of 0.151 inch, 0.187 inch and 0.151 inch respectively. Transmission lines 394, 396, 398, 400, 402 and 404 had lengths of 10.44, 2.31, 24.83, 2.17, 13.11 and 0.17 inches, respectively. Capacitor 406 and inductor 408 had magnitudes of 7.62 picofarads and 138.94 nanohenries, respectively. The measurements of VSWR vs. frequency were taken at the output designated 410 in the same manner as the previous example to provide the curve 412 in FIG. 20.

Figure 20:
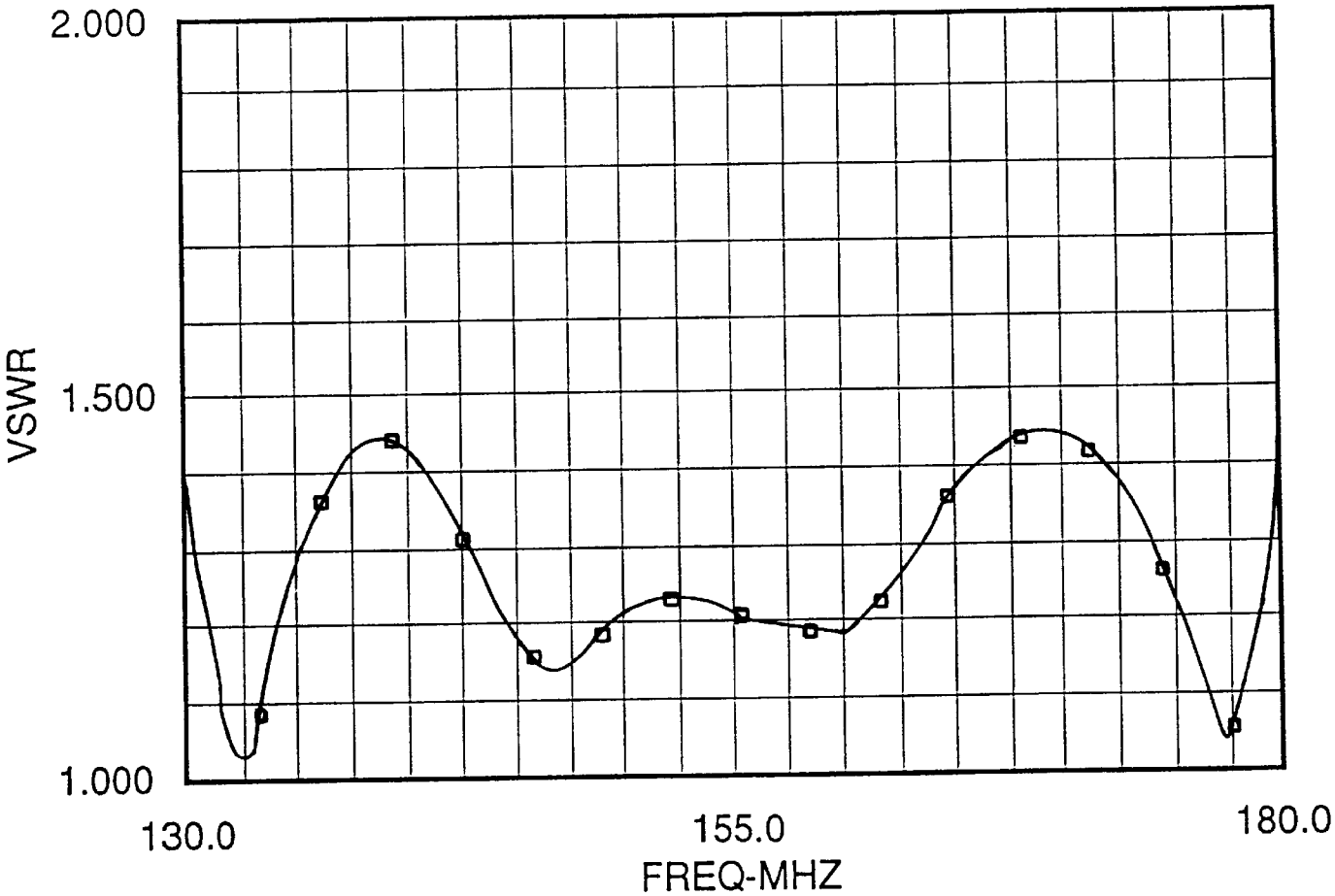

Curve 412 in FIG. 20 illustrates the still further improvement of even lower VSWR over the broad frequency range of 130–180 MHz in the antenna system with matching networks according to this embodiment of the present invention.

Figure 21:
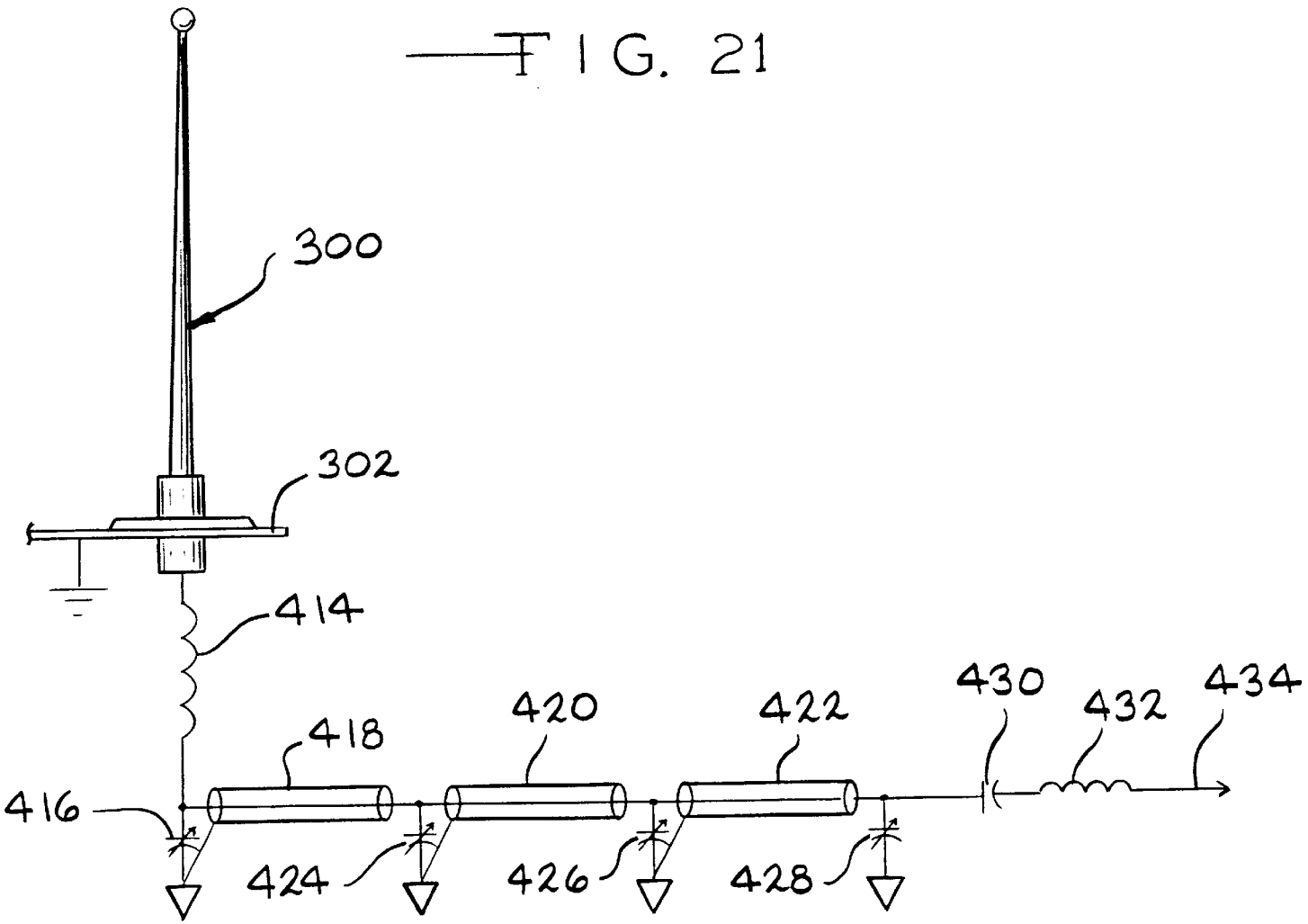

In the last example, the matching network included substantially the same series—connected transmission lines but capacitors in place of the shunt transmission lines. Referring to FIG. 21, inductor 414 had a magnitude of 75.30 nanohenries and capacitor 416 a magnitude of 1.79 picofarads. Transmission lines 418, 420 and 422 had inner diameters of 0.151, 0.186 and 0.148 inch, respectively and lengths of 11.21, 24.64 and 12.42 inches respectively. Capacitors 424, 426 and 428 had magnitudes of 58.89, 2.89 and 8.39 picofarads, respectively. Capacitor 430 and inductor 432 had magnitudes of 7.90 picofarads and 136.50 nanohenries, respectively. The measurements of VSWR vs. frequency were taken at the output designated 434 in the same manner as the previous example to provide the curve 436 in FIG. 22.

Figure 22:
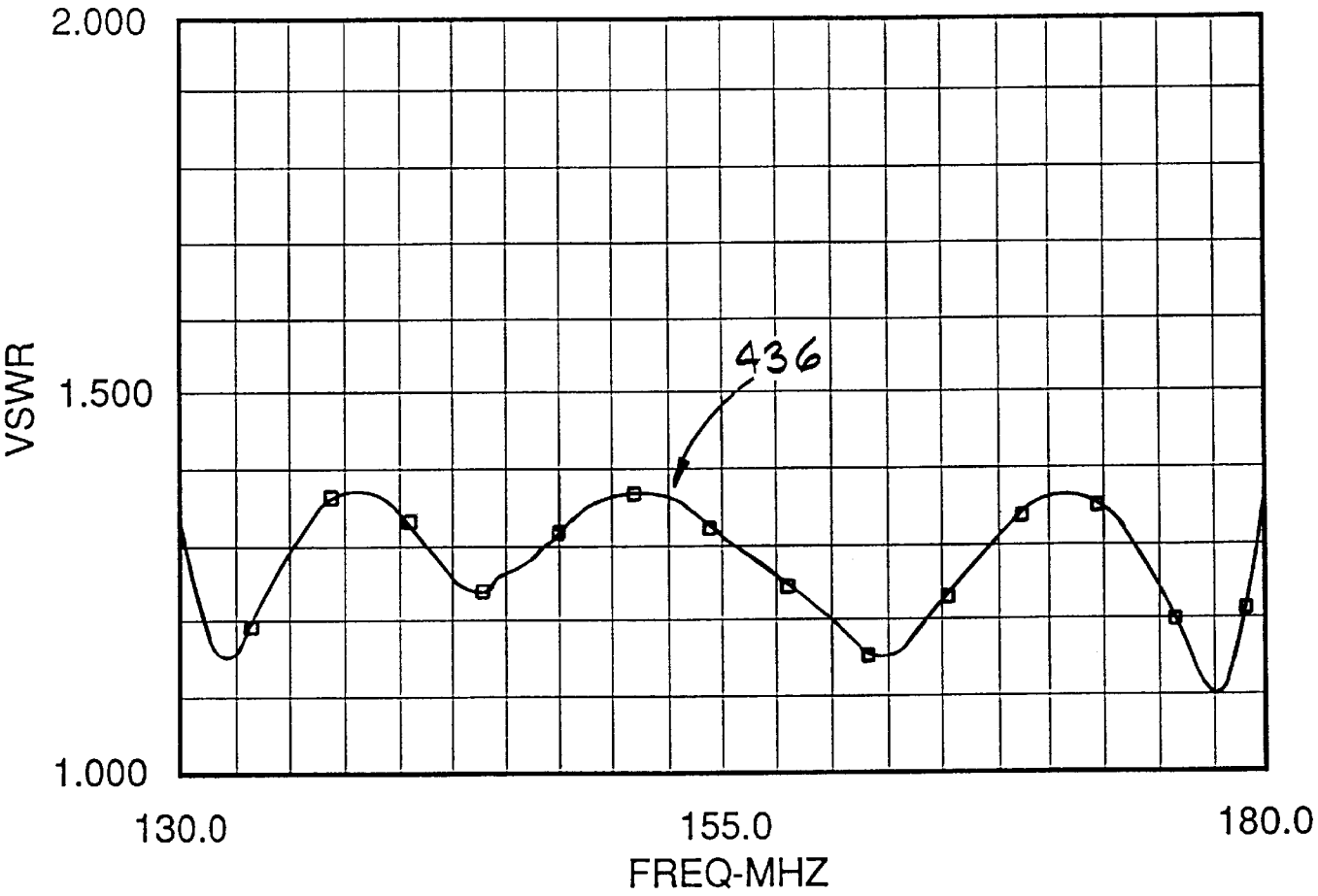

Curve 436 in FIG. 22 illustrates the even further improvement of still lower VSWR over the broad frequency range of 130–180 MHz in the antenna system with matching network according to this embodiment of the present invention.

It is therefore apparent that the present invention accomplishes its intended objective. While embodiment of the present invention have been described in detail, that is for the purpose of illustration, not limitation.

What is claimed is:

1. A broadband multiband antenna system for use with a broadcast radio receiver and a high and low frequency communications apparatus in a vehicle, said antenna system comprising:

a) a broadcast antenna mounted to the vehicle by means of a base;

b) a first distributed matching network for coupling said antenna to the broadcast receiver and to the low frequency communications equipment in the vehicle, said distributed matching network including a low pass series reactive element connected directly to said antenna at said base, transmission lines means connected to said low pass series reactive element and matching means operating associated with said transmission lines means to provide characteristics of said distributed matching network resulting in broad bandwidth, low standing wave ratio and low power loss operation of said low frequency communications equipment from said antenna so that said antenna and said base maintain the outer visible appearance of an OEM-supplied vehicle antenna;

c) a broadcast coupler connected between said distributed matching network and said broadcast receiver and low frequency communications equipment for providing isolation between said broadcast receiver and said low frequency communications equipment; and d) a second distributed matching network for coupling said antenna to the high frequency communications equipment in the vehicle, said distributed matching network including a high pass series reactive element connected directly to said antenna at said base, transmission line means connected to said high pass series reactive element and matching means operatively associated with said transmission line means to provide characteristics of said distributed matching network resulting in broad bandwidth, low standing wave ratio and low power loss operation of said high frequency communications equipment from said antenna so that said antenna and said base maintain the outer visible appearance of an OEM-supplied vehicle antenna.

2. A broadband multiband antenna system according to claim 1 wherein said low pass series reactive element comprises an inductor and said high pass series reactive element comprise a capacitor.

3. A broadband matching network for coupling a broadcast radio receiver and communications apparatus to a vehicle broadcast antenna mounted to a vehicle by means of a base, and wherein a broadcast coupler provides isolation between said radio receiver and said communications apparatus, said matching network comprising:

a) a series reactive element having first and second ends, said first end being connected electrically through said base to said antenna;

b) at least one transmission line having first and second ends, said first end being connected to the second end of said series reactive element;

c) a first matching element connected to the junction of said series reactive element and said transmission line;

d) a second matching element connected to said second end of said transmission line;

e) means for connecting said broadcast coupler to the junction of said transmission line and said second matching element;

f) said series reactive element, said at least one transmission line and said first and second matching elements being selected to provide a relatively low standing wave ratio over a broad frequency range in a manner withstanding the full power of said communications apparatus so that said matching network is entirely within the vehicle and said antenna and base maintain the outer visible appearance of an OEM-supplied vehicle antenna; and g) said broadcast coupler comprising a series LC tuned circuit connected between said communications apparatus and the junction of said second matching element and said second end of said transmission line and a parallel LC low pass network connected between said broadcast receiver and the junction of said second matching element and said second end of said transmission line.

4. A broadband matching network according to claim 3, wherein said series reactive element comprises an inductor.

5. A broadband matching network according to claim 3, wherein each of said first and second matching elements comprises a variable capacitor.

6. A broadband matching network according to claim 3, wherein said communications apparatus comprises a transceiver.

7. A broadband matching network for coupling a broadcast radio receiver and communications apparatus to a vehicle broadcast antenna mounted to a vehicle by means of a base and wherein a broadcast coupler provides isolation between said radio receiver and said communications apparatus, said matching network comprising:

a) a series reactive element having first and second ends, said first end being connected electrically through said base to said antenna;

b) a plurality of transmission lines connected in series, adjacent ones of said transmission lines being joined at junctions, the first of said transmission lines having an end joined to the second end of said series reactive element and the last of said transmission lines having an end;

c) a plurality of matching elements, one of said matching elements being connected to the junction of said series reactive element and said first transmission line, and the other of said matching elements being connected to said end of said last of said transmission lines and the remainder of said matching elements being connected to said junctions of said transmission lines;

d) means for connecting said broadcast coupler to the junction of said end of said last transmission line said other of said matching elements;

e) said series reactive element, said plurality of transmission lines and said plurality of matching elements being selected to provide a relatively low standing wave ratio over a broad frequency range in a manner withstanding the full power of said communications apparatus so that said matching network is entirely within the vehicle and said antenna and base maintain the outer visible appearance of an OEM-supplied vehicle antenna; and f) said series reactive element comprising an inductor, three transmission lines being provided between said inductor and said broadcast coupler, said matching elements comprising four variable capacitors and the magnitudes of said inductor and said variable capacitors and the lengths of said transmission lines being selected to provide AM/FM broadcast operation of said receiver and broadband VHF operation of said communications apparatus.

8. A broadband matching network according to claim 7, wherein said series reactive element comprises an inductor.

9. A broadband matching network according to claim 7, wherein said matching elements are connected in shunt relation to said transmission lines.

10. A broadband matching network according to claim 9, wherein each of said matching elements comprises a variable capacitor.

11. A broadband matching network for coupling a broadcast radio receiver and communications apparatus to a vehicle broadcast antenna mounted to a vehicle by means of a base and wherein a broadcast coupler provides isolation between said radio receiver and said communications apparatus, said matching network comprising:

a) a series reactive element having first and second ends, said first end being connected electrically through said base to said antenna;

b) a plurality of transmission lines connected in series, adjacent ones of said transmission lines being joined at junctions, the first of said transmission lines having an end joined to the second end of said series reactive element and the last of said transmission lines having an end;

c) a plurality of matching elements, one of said matching elements being connected to the junction of said series reactive element and said first transmission line, and the other of said matching elements being connected to said end of said last of said transmission lines and the remainder of said matching elements being connected to said junctions of said transmission lines;

d) means for connecting said broadcast coupler to the junction of said end of said last transmission line said other of said matching elements;

e) said series reactive element, said plurality of transmission lines and said plurality of matching elements being selected to provide a relatively low standing wave ratio over a broad frequency range in a manner withstanding the full power of said communications apparatus so that said matching network is entirely within the vehicle and said antenna and base maintain the outer visible appearance of an OEM-supplied vehicle antenna; and f) said series reactive element comprising an inductor, a plurality of transmission lines being provided between said inductor and said broadcast coupler, said matching elements comprising a plurality of variable capacitors and the magnitudes of said inductor and said variable capacitors and the lengths of said transmission lines being selected to provide AM/FM broadcast operation of said receiver and broadband VHF operation of said communications apparatus.

* * * * *